US008763597B2

(12) United States Patent
Maeda

(10) Patent No.: US 8,763,597 B2
(45) Date of Patent: Jul. 1, 2014

(54) TOY GUN AND ATTACHMENT DEVICE

(75) Inventor: Tetsuo Maeda, Tokyo (JP)

(73) Assignee: Maruzen Company Limited, Tokyo (JP)

( * ) Notice: Subject to any disclaimer, the term of this patent is extended or adjusted under 35 U.S.C. 154(b) by 0 days.

(21) Appl. No.: 13/358,655

(22) Filed: Jan. 26, 2012

(65) Prior Publication Data

US 2013/0192577 A1 Aug. 1, 2013

(51) Int. Cl.
*F41B 11/06* (2006.01)

(52) U.S. Cl.
USPC ..... 124/74; 124/71; 124/73

(58) Field of Classification Search
CPC ..... F41B 11/00; F41B 11/62; F41B 11/721; F41B 11/722; F41B 11/723
USPC ..... 124/56, 74, 70, 71, 73; 89/7
See application file for complete search history.

(56) References Cited

U.S. PATENT DOCUMENTS

| | | | | |
|---|---|---|---|---|
| 3,830,214 | A * | 8/1974 | Curtis | 124/57 |
| 4,148,245 | A * | 4/1979 | Steffanus et al. | 89/7 |
| 5,078,118 | A * | 1/1992 | Perrone | 124/74 |
| 5,341,790 | A * | 8/1994 | Ebert | 124/69 |
| 5,497,758 | A * | 3/1996 | Dobbins et al. | 124/73 |
| 5,927,261 | A * | 7/1999 | Bofill | 124/80 |
| 6,557,542 | B1 * | 5/2003 | Orr | 124/70 |
| 6,892,718 | B2 * | 5/2005 | Tiberius et al. | 124/74 |
| 7,290,539 | B2 | 11/2007 | Maeda et al. | |
| 7,334,598 | B1 * | 2/2008 | Hollars | 137/116.3 |
| 7,540,280 | B2 * | 6/2009 | Liao et al. | 124/74 |
| 7,614,394 | B2 * | 11/2009 | Li | 124/73 |
| 7,856,969 | B2 * | 12/2010 | Maeda et al. | 124/71 |
| 8,434,465 | B2 * | 5/2013 | Call | 124/73 |
| 2003/0101979 | A1 * | 6/2003 | Schavone | 124/74 |
| 2005/0193999 | A1 * | 9/2005 | Lai et al. | 124/71 |
| 2006/0266342 | A1 * | 11/2006 | Teipel et al. | 124/74 |

(Continued)

FOREIGN PATENT DOCUMENTS

| | | | | |
|---|---|---|---|---|
| DE | 3521800 | A1 | 9/1986 | |
| DE | 10116010 | A1 | 10/2002 | |
| DE | 10116010 | A1 * | 10/2002 | F41B 11/26 |
| JP | 07-0041292 | U | 7/1995 | |

OTHER PUBLICATIONS

Extended European Search Report issued in EP Application No. 12000323.1, dated Jun. 28, 2012.

*Primary Examiner* — Bret Hayes
*Assistant Examiner* — Derrick Morgan
(74) *Attorney, Agent, or Firm* — Rader, Fishman & Grauer PLLC

(57) ABSTRACT

It is made possible to use a toy gun that fires bullets by compressed gas without the replacement of a gas cartridge for a long time and the portability of the gas cartridge is enhanced. The air chamber body placed in the toy gun forms an air chamber. Compressed gas in the air chamber body passes through a gas discharge portion and shoots a bullet held by a bullet holding portion out of a muzzle. A valve establishes or breaks communication between the air chamber body and the gas discharge portion according to operation with an operation portion. The toy gun includes multiple gas cartridge attachment portions. A gas bomb is attached to each of the gas cartridge attachment portions. Each gas cartridge attachment portion is provided with a first valve portion. Compressed gas in the gas bomb attached to each gas cartridge attachment portion is guided into the air chamber by way of a gas introduction portion.

7 Claims, 17 Drawing Sheets

(56) References Cited

U.S. PATENT DOCUMENTS

| | | | | |
|---|---|---|---|---|
| 2007/0062507 | A1* | 3/2007 | Broersma | 124/70 |
| 2007/0062510 | A1* | 3/2007 | Broersma | 124/74 |
| 2008/0017180 | A1* | 1/2008 | Maeda et al. | 124/74 |
| 2008/0210210 | A1* | 9/2008 | Colby | 124/73 |
| 2009/0277436 | A1* | 11/2009 | Wei | 124/74 |
| 2010/0319668 | A1* | 12/2010 | Maeda | 124/73 |
| 2011/0048395 | A1* | 3/2011 | Maeda | 124/76 |
| 2011/0056472 | A1* | 3/2011 | Stone | 124/74 |
| 2011/0265775 | A1* | 11/2011 | Maeda | 124/73 |
| 2012/0129136 | A1* | 5/2012 | Dvorak | 434/18 |
| 2013/0269671 | A1* | 10/2013 | Tseng | 124/74 |

* cited by examiner

TOY GUN AND ATTACHMENT DEVICE

BACKGROUND OF THE INVENTION

1. Field of the Invention

The present invention relates to a toy gun to which a gas cartridge can be attached and which fires bullets by pressure from compressed gas in the gas cartridge, and relates to an attachment device for attaching a gas cartridge to the toy gun.

2. Description of the Related Art

Toy guns to which a gas cartridge can be attached and which fire bullets by pressure from compressed gas in the gas cartridge have conventionally become widespread. An example of such toy guns is the toy gun described in JP-Utility Model(UM)-A-Hei 7(1995)-41292.

According to the description in JP-UM-A-Hei 7-41292, one bomb 22 (gas cartridge) is attached to this toy gun. The bomb 22 houses compressed carbon dioxide gas and the air chamber 24 of the toy gun is filled with the carbon dioxide gas. A user of the toy gun pulls a cocking head 34 backward to position a piston 51 rearward. The user thereafter advances and returns the cocking head 34 to the original position. When the user pulls a trigger 61 in this state, the piston 51 advances. When the piston 51 advances, air in a cylinder 44 is let out into a barrel 15 and a bullet 12 in the barrel 15 is shot out of the muzzle 16. When the piston 51 advances, a hammer bar 31 advances and hits a valve 26 to break the discontinuation between the air chamber 24 and a hammer bar housing chamber 25 by the valve 26. As a result, gas in the air chamber 24 is let out into the hammer bar housing chamber 25 to push the hammer bar 31 backward. The cocking head 34 is thereby retreated to position the piston 51 rearward. Each time the trigger 61 is thereafter pulled, the cocking head 34 automatically advances and retreats.

In the toy gun described in JP-UM-A-Hei 7-41292, the cocking head 34 automatically advances and retreats and a large number of bullets are fired in a short time like an actual gun. For this reason, the toy gun described in JP-UM-A-Hei 7-41292 consumes a large quantity of compressed gas.

To use the toy gun without the replacement of the bomb 22 for a long time, the bomb 22 could be increased in size. However, this makes the bomb 22 bothersome to carry.

SUMMARY OF THE INVENTION

It is an object of the invention to make it possible to use a toy gun configured to fire bullets by compressed gas without the replacement of a gas cartridge for a long time and enhance the portability of the gas cartridge.

A toy gun of the invention includes: a bullet holding portion that holds bullets; an air chamber body that forms an air chamber; a gas discharge portion that guides compressed gas in the air chamber to bullets held by the bullet holding portion; a valve that establishes or breaks communication between the air chamber and the gas discharge portion; an operation portion that opens/closes the valve; multiple gas cartridge attachment portions to which a gas cartridge for supplying compressed gas is attached; a first valve portion provided in each of the gas cartridge attachment portions; and a gas introduction portion that guides compressed gas from a gas cartridge attached to each the gas cartridge attachment portion into the air chamber.

The attachment device of the invention includes: multiple gas cartridge attachment portions to which a gas cartridge for supplying compressed gas is attached; a unit attaching portion that can be freely attached to and detached from a unit attached portion provided in a toy gun and guides compressed gas supplied from a gas cartridge attached to each the gas cartridge attachment portion into the toy gun; a first valve portion provided in each of the gas cartridge attachment portions; and a second valve portion provided in the unit attaching portion.

According to another aspect, the attachment device of the invention includes: an air chamber body that can be freely attached to and detached from a toy gun having a bullet holding portion for holding bullets and forms an air chamber; a gas discharge portion that is provided in the toy gun and guides compressed gas in the air chamber to bullets held by the bullet holding portion; a valve that establishes or breaks communication with the air chamber; multiple gas cartridge attachment portions to which a gas cartridge for supplying compressed gas is attached; a first valve portion provided in each of the gas cartridge attachment portions; and a gas introduction portion that guides compressed gas from a gas cartridge attached to each the gas cartridge attachment portion into the air chamber.

According to the invention, multiple gas cartridges can be attached. Each the gas cartridge attachment portion can be closed with a first valve portion. For this reason, instead of a large-sized gas cartridge, multiple small-sized gas cartridges can be used to use the toy gun. Therefore, it is possible to use the toy gun configured to fire bullets by compressed gas without the replacement of a gas cartridge for a long time. In addition, the portability of the gas cartridge is enhanced. Since the gas cartridge can be reduced in size, the toy gun can be flexibly designed.

DETAILED DESCRIPTION OF THE PREFERRED EMBODIMENTS

Figure 1:
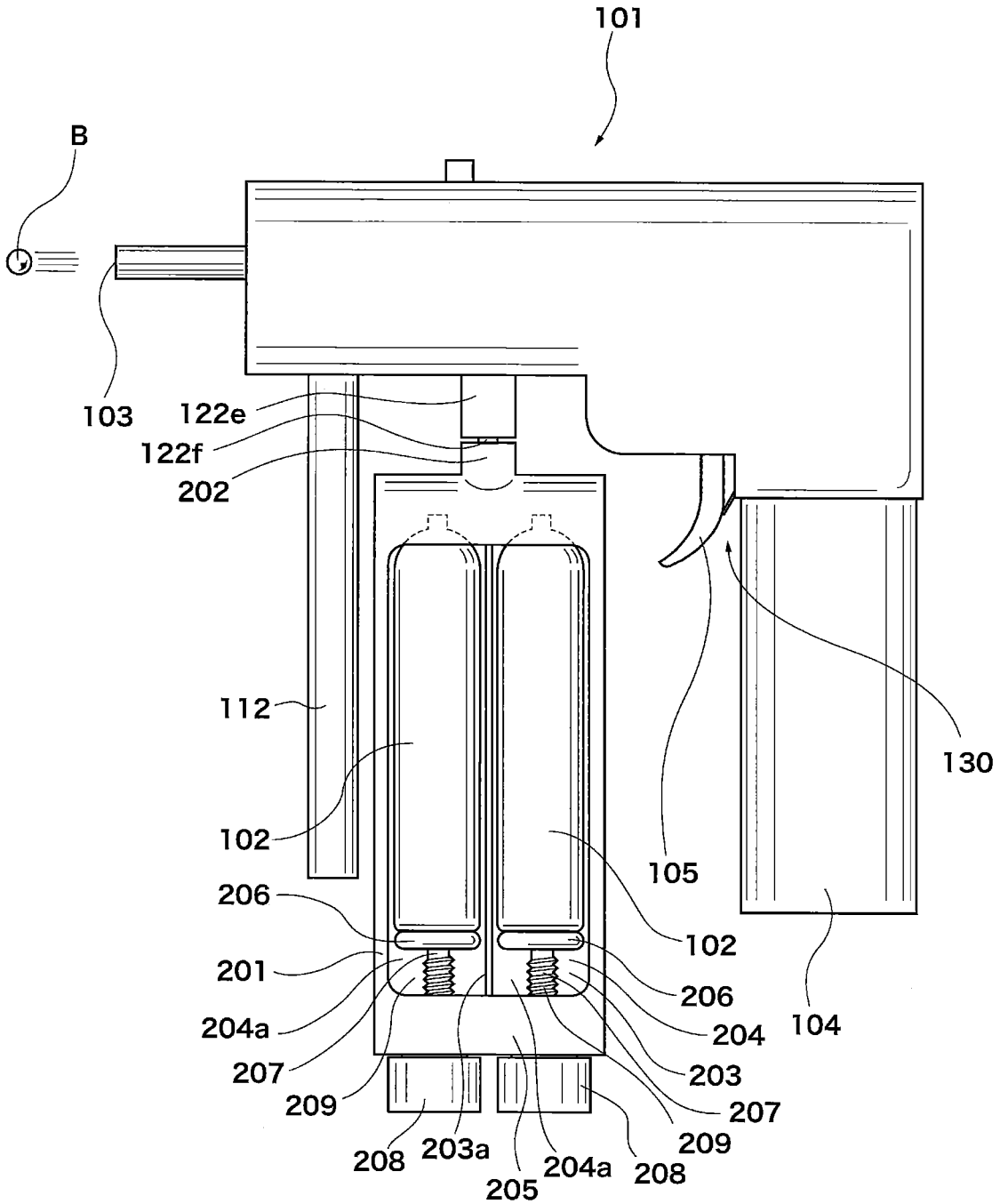
FIG. 1 is a left side view of a toy gun in a first embodiment.

A description will be given to an embodiment with reference to FIG. 1 to FIG. 13. The embodiment will be designated as first embodiment for convenience of explanation. FIG. 1 is a left side view of a toy gun 101. A gas bomb 102 (gas cartridge) is attached to the toy gun 101. When a user uses the toy gun 101, he/she holds a grip 104 with his/her palm, places his/her finger on a trigger 105, aims a muzzle 103 at an object to be shot (for example, a target), and pulls the trigger 105. When the trigger 105 is pulled, a bullet B is shot out of the muzzle 103 by the pressure of compressed gas filled in the gas bomb 102. In the following description, the side where the muzzle 103 is located will be designated as the front side of the toy gun 101 and the side where the grip 104 is located will be designated as the rear side of the toy gun 101.

Figure 2:
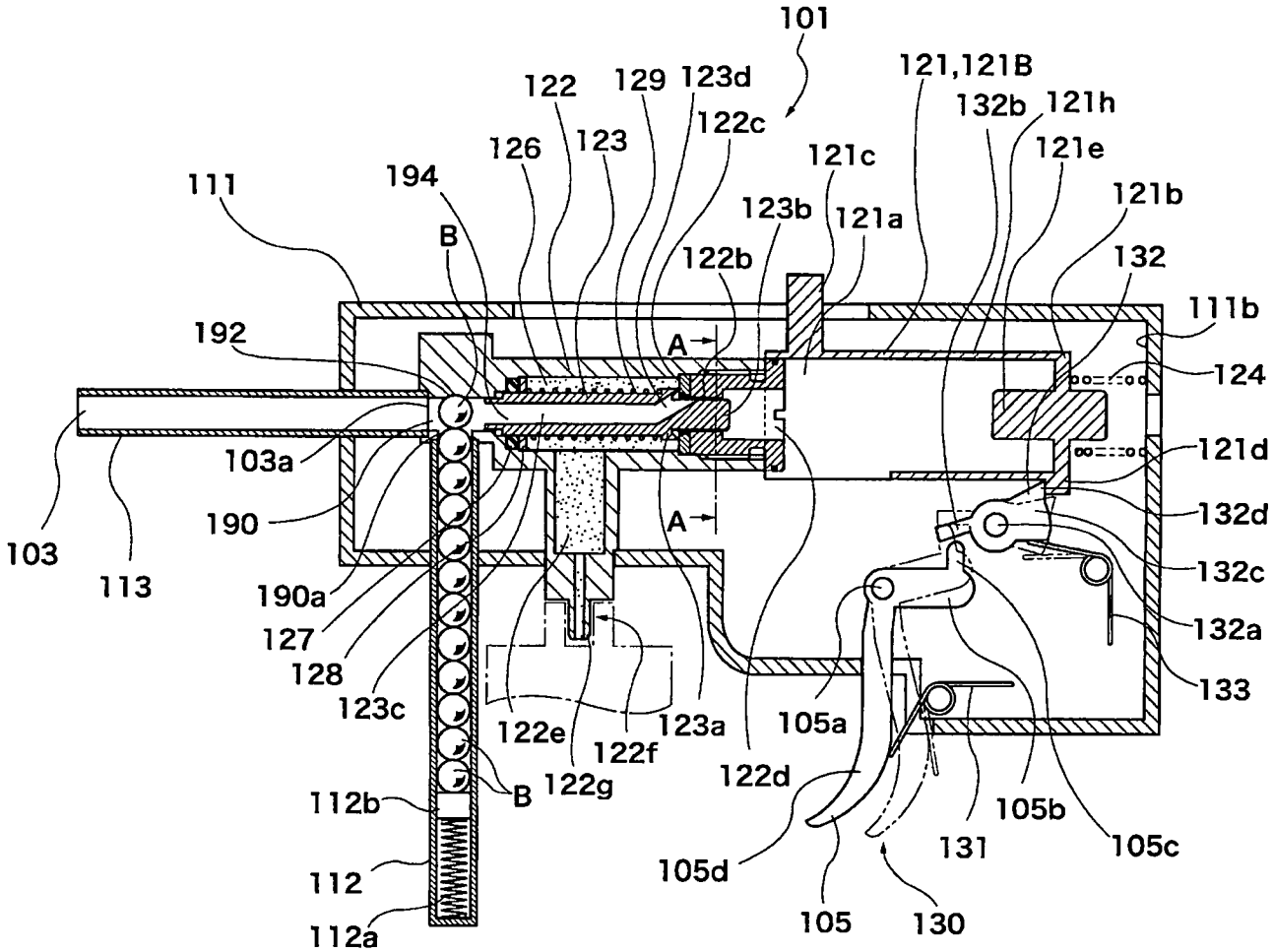
FIG. 2 is a left sectional view illustrating the internal structure of a toy gun in the first embodiment.

FIG. 2 is a left sectional view illustrating the internal structure of the toy gun 101. The area in FIG. 2 filled with compressed gas is filled with dots. The toy gun 101 includes a frame 111, a magazine 112, a barrel 113, a bolt 121, an air chamber body 122, a valve 123, a bolt spring 124, and a valve spring 129. The frame 111 forms part of the gun barrel and defines the front-rear direction of the toy gun 101.

The magazine 112 is extended downward from the bullet introduction port 190*a* (described later) provided in the air chamber body 122. The magazine 112 is formed in the shape of a cylinder with only one end thereof open and is attached to and detached from the frame 111 with the closed end thereof positioned downward. In the magazine 112, a magazine spring 112*a* and a magazine follower 112*b* are placed. The magazine spring 112*a* connects the closed end of the magazine 112 and the magazine follower 112*b* together. In the magazine 112, bullets B are housed. The bullets B in the magazine 112 are pushed up by the magazine spring 112*a* and fed from the bullet introduction port 190*a* into a passage 190 (described later).

The barrel 113 is extended in the front-rear direction of the gun barrel and is protruded from the frame 111 frontward of the toy gun 101. The front end of the barrel 113 is the muzzle 103. The rear end of the barrel 113 is coupled to the front side of the frame 111. The barrel 113 may be housed in the frame 111.

The air chamber body 122 is housed in the frame 111. In the air chamber body 122, the passage 190 is formed. The passage 190 is linearly extended from the rear end portion 103*a* of the barrel 113 located on the opposite side to the muzzle 103 in the front-rear direction of the gun barrel and communicates with an air chamber 126 (described later). A bullet B fed from the magazine 112 to the bullet introduction port 190*a* is pushed up by the magazine follower 112*b* and positioned in the passage 190 and is held by the bullet holding portion 192. An example of the bullet holding portion 192 is a minute recess formed in the upper surface of the internal space of the passage 190.

In the air chamber body 122, the air chamber 126 is formed. The above-mentioned passage 190 is extended form the front side of the air chamber 126. The rear side of the air chamber 126 is closed with a rear lid 122*a*. In the rear lid 122*a*, a through hole 122*b* penetrating the rear lid in the front-rear direction of the gun barrel is formed. A ring-shaped packing 122*c* is attached to around the through hole 122*b* in the front end face of the rear lid 122*a*. The rear side of the through hole 122*b* is large in inside diameter and forms a fitting hole 122*d*. The abutment portion 121*e* (described later) provided on the bolt 121 gets into the fitting hole 122*d*.

In the air chamber body 122, a gas introduction passage 122*e* is formed. The air chamber body 122 is in such a shape that it is protruded downward and is fit in the frame 111 and forms the gas introduction passage 122*e*.

The bolt 121 is housed in the frame 111. The bolt 121 is cylindrical and is extended in the front-rear direction of the gun barrel. The front side of the bolt 121 is an open end 121*a*. The rear side of the bolt 121 is a closed end 121*b*. A lever 121*c* is protruded upward from the upper surface of the bolt 121. A part of the lever 121*c* is protruded upward from the frame 111. A locking protrusion 121*d* is protruded downward from the lower surface of the rear side of the bolt 121. The abutment portion 121*e* is protruded from the closed end 121*b* toward the internal space of the bolt 121.

Figure 3:
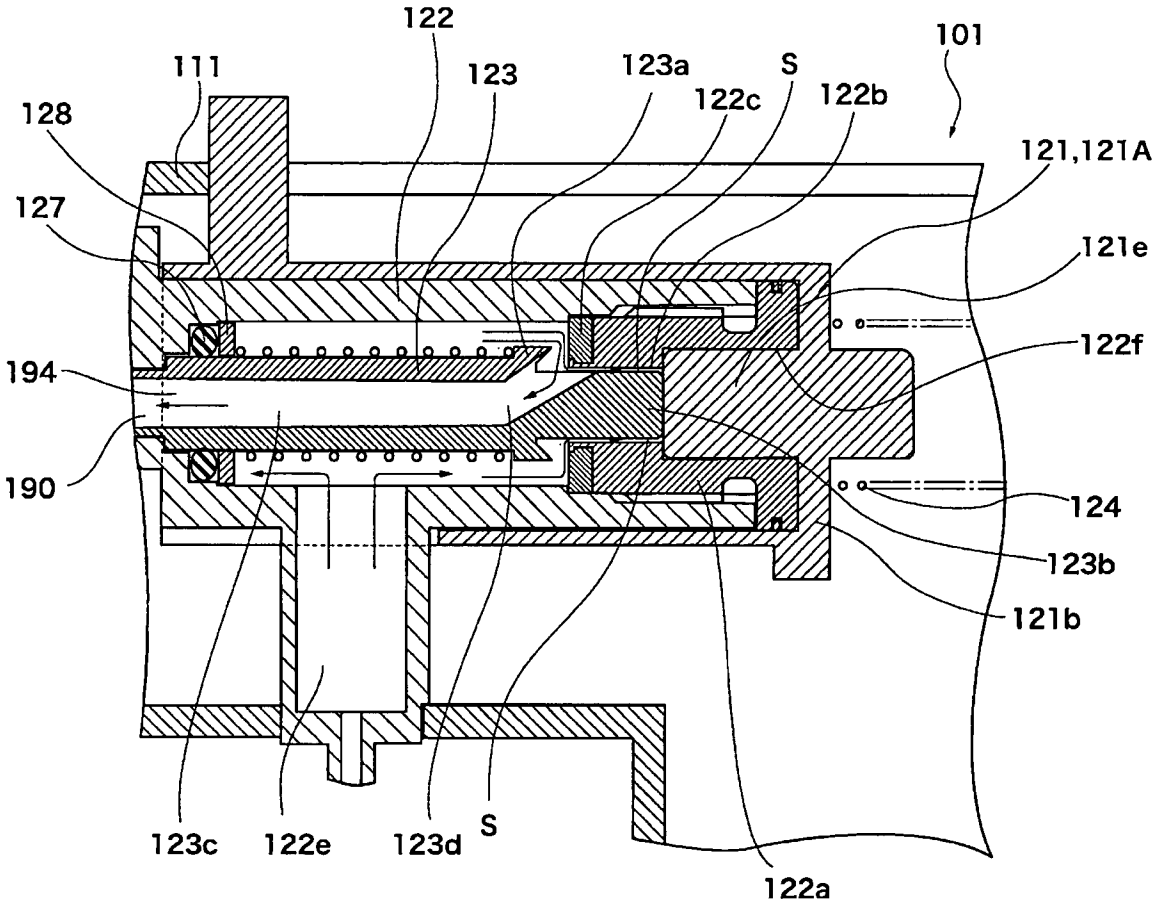
FIG. 3 is a left sectional view illustrating the internal structure of a toy gun in the first embodiment with a bolt positioned in the pressing position.

The bolt 121 can be freely moved in the front-rear direction of the gun barrel. When a user pulls the trigger 105, the bolt 121 starts advancing and is caused to reciprocate between the pressing position 121A and the retreat position 121B by the bolt spring 124 and the pressure of compressed gas. The retreat position 121B cited here refers to such a position of the bolt 121 that the abutment portion 121*e* is away from the sliding protrusion 123*b* (described later) of the valve 123 on the rear side of the toy gun 101. FIG. 2 shows the bolt 121 as is positioned in the retreat position 121B. The pressing position 121A refers to such a position of the bolt 121 that the abutment portion 121*e* is in contact with the sliding protrusion 123*b* of the valve 123 ahead of the retreat position 121B in the front-rear direction of the toy gun 101. FIG. 3 shows the bolt 121 as is positioned in the pressing position 121A.

The bolt spring 124 is positioned between the outside surface of the closed end 121*b* of the bolt 121 and the inside surface 111*b* of the rear part of the frame 111. The bolt spring 124 pushes the bolt 121 positioned in the retreat position 121B forward to the pressing position 121A.

The valve 123 is positioned between the air chamber 126 and the passage 190 and is placed in the air chamber 126. A flange portion 123*a* and the sliding protrusion 123*b* are formed on the rear end side of the valve 123. The flange portion 123*a* is radially protruded from the circumference of the valve 123. The sliding protrusion 123*b* gets into the through hole 122*b* and is protruded to the fitting hole 122*d* side. The valve 123 forms a straight passage 123*c* and an inclined passage 123*d*. The straight passage 123*c* and the inclined passage 123*d* communicate with each other and compressed gas can pass therein. The straight passage 123*c* is open in the front end face of the valve 123 and is extended in the front-rear direction of the gun barrel. The inclined passage 123*d* is extended in a direction inclined from the straight passage 123*c* and is open between the flange portion 123*a* and the sliding protrusion 123*b*. An O-ring 127 and a washer 128 are fit to the circumference of the valve 123 on the front end side. The O-ring 127 is sandwiched between the washer 128 and the inner wall of the air chamber body 122.

The valve spring 129 is positioned between the washer 128 and the flange portion 123*a* and is so placed that the valve spring is wound around the valve 123. The valve spring 129 pushes the washer 128 forward to press the O-ring 127 against the inner wall of the air chamber body 122. The valve spring 129 presses the flange portion 123*a* against the packing 122*c*. As a result, communication between the passage 190 and the air chamber 126 is broken.

FIG. 3 is a left sectional view illustrating the internal structure of the toy gun 101 with the bolt 121 positioned in the pressing position 121A. When the bolt 121 advances and reaches the pressing position 121A, the circumferential portion of the air chamber body 122 on the rear side is fit in the open end 121*a* of the bolt 121. (Refer to FIG. 2.) When the bolt 121 further advances, the abutment portion 121*e* pushes forward the sliding protrusion 123*b* of the valve 123 protruded into the fitting hole 122*d*. As a result, the valve 123 slides to the front side and the flange portion 123*a* is broken away from the packing 122*c*. Accordingly, communication between the passage 190 and the air chamber 126 is established.

When communication between the passage 190 and the air chamber 126 is established, compressed gas filled in the air chamber 126 flows as indicated by arrows in FIG. 3. That is, the compressed gas passes through the inclined passage 123*d* and the straight passage 123*c* and flows into the passage 190 to press the rear face of a bullet B (Refer to FIG. 2) held by the bullet holding portion 192. As a result, the bullet B flies out of the muzzle 103 (Refer to FIG. 2). The inclined passage 123*d*, straight passage 123*c*, and passage 190 comprises a gas discharge portion 194 for guiding compressed gas in the air chamber 126 to a bullet B held by the bullet holding portion 192. The valve 123 establishes and breaks communication between the air chamber 126 and the gas discharge portion 194.

When communication between the passage 190 and the air chamber 126 is established, the compressed gas gets also into the gap S between the inner wall surface of the through hole 122*b* and the sliding protrusion 123*b* as indicated by arrows in FIG. 3. The compressed gas passes through the through hole 122*b* and pushes the abutment portion 121*e* backward. As a result, the bolt 121 starts retreating and reaches the retreat position 121B. (Refer to FIG. 2.) The bolt 121 that has reached the retreat position 121B is pushed by the bolt spring 124 and advances again. When the bolt 121 reaches the pressing position 121A, the bolt pushes the sliding protrusion 123*b* of the valve 123 forward. As mentioned above, the bolt 121 makes reciprocating motion and repeats advance and retreat. While the bolt 121 makes one reciprocating motion, the bolt is abutted against and broken away from the valve 123 and thereby establishes and breaks communication between the passage 190 and the air chamber 126.

When the abutment portion 121*e* is broken away from the sliding protrusion 123*b*, the valve spring 129 pushes back the valve 123 backward. This slides the valve 123 backward and the flange portion 123*a* is brought into tight contact with the packing 122*c*. As a result, communication between the passage 190 and the air chamber 126 is broken. Thereafter, the air chamber 126 is filled therein with compressed gas supplied from the gas introduction passage 122*e*.

FIG. 2 will be referred to again. The toy gun 101 includes the trigger 105, a trigger spring 131, a bolt shear 132, and a bolt shear spring 133. The trigger 105 is positioned ahead of the grip 104. (Refer to FIG. 1.) The trigger 105 is attached to the frame 111 so that the trigger can be freely rotated around a fulcrum 105*a*. The trigger 105 includes a finger hooking portion 105*d* and a backward extended portion 105*b*. The finger hooking portion 105*d* is extended downward from the fulcrum 105*a*. The backward extended portion 105*b* is extended backward from the fulcrum 105*a*. A bolt shear push-up portion 105*c* is protruded upward from the upper surface of the backward extended portion 105*b*. The trigger spring 131 pushes the finger hooking portion 105*d* clockwise in FIG. 2.

The bolt shear 132 is provided in a position sandwiched between the bolt shear push-up portion 105*c* located therebelow and the bolt 121 located thereabove. The bolt shear 132 is attached to the frame 111 so that the bolt shear can be freely rotated around the axial center 132*a* thereof. The bolt shear 132 includes a flat plate-like forward protruded portion 132*b* and a backward protruded portion 132*c* widened like a fan as laterally viewed. The forward protruded portion 132*b* is protruded to ahead of the axial center 132*a*. The backward protruded portion 132*c* is protruded to behind the axial center 132*a*. A stopper portion 132*d* for stopping the locking protrusion 121*d* of the bolt 121 is provided above the backward protruded portion 132*c*. The bolt shear spring 133 is abutted against the lower surface of the backward protruded portion 132*c* and rotates the bolt shear 132 counterclockwise in FIG. 2 to lift the stopper portion 132*d* upward. When the stopper portion 132*d* is lifted upward, the stopper portion 132*d* hooks on the locking protrusion 121*d* of the bolt 121 and prevents the advance of the bolt 121.

When a user holds the lever 121*c* and moves the bolt backward, the locking protrusion 121*d* climbs over the stopper portion 132*d*. When the user subsequently releases the lever 121*c*, the bolt 121 is pushed by the bolt spring 124 and advances and the locking protrusion 121*d* hooks on the stopper portion 132*d*. When the user thereafter pulls the trigger 105 backward by his/her finger, the trigger 105 is rotated counterclockwise in FIG. 2 and moves the bolt shear push-up portion 105*c* to displace the forward protruded portion 132*b* upward. This rotates the bolt shear 132 clockwise in FIG. 2 and the locking protrusion 121*d* is displaced downward. As a result, the bolt 121 is pushed by the bolt spring 124 and advances and the valve 123 is moved forward. Communication between the air chamber 126 and the gas discharge portion 194 is thereby established. In FIG. 2, the state of the trigger 105, trigger spring 131, bolt shear 132, and bolt shear spring 133 with the trigger 105 pulled backward is shown by alternate long and two short dashes line.

When the user releases the trigger 105, the trigger spring 131 pushes the finger hooking portion 105*d* clockwise in FIG. 2 and displaces the bolt shear push-up portion 105*c* downward. At this time, the bolt shear spring 133 pushes the bolt shear 132 so as to rotate the bolt shear counterclockwise in FIG. 2. For this reason, the forward protruded portion 132*b* is moved downward and the stopper portion 132*d* is moved upward. As a result, the advance of the bolt 121 is prevented and the valve 123 is pushed backward. Thus communication between the air chamber 126 and the gas discharge portion 194 is broken. As mentioned above, the trigger 105 forms an operation portion 130 for opening/closing the valve 123.

Consideration will be given to the gas bomb 102 used in the toy gun 101 and a bomb attachment device 201 for attaching the gas bomb 102 to the toy gun 101. The bomb attachment device 201 is equivalent to "attachment device" in WHAT IS CLAIMED IS. FIG. 1 will be referred to. In this embodiment, the gas bomb 102 is housed in the bomb attachment device 201 and positioned ahead of the trigger 105. The bomb attachment device 201 is attached to a unit attached portion 122*f* (Refer to FIG. 2 as well) with the gas bomb 102 housed therein. The unit attached portion 122*f* is provided at the end below the gas introduction passage 122*e*.

The bomb attachment device 201 is in the shape of a vertically long box. A unit attaching portion 202 is protruded from the upper surface of the bomb attachment device 201. In the bomb attachment device 201, a housing space 203 is formed for housing two gas bombs 102. In the housing space 203, a partitioning portion 203*a* is provided. The partitioning portion 203*a* partitions the housing space 203 into placement spaces 204*a* for placing individual gas bombs 102. In a side surface of the bomb attachment device 201, a gas bomb introduction port 204 continuing to the housing space 203 is open. Two bomb holders 206 are placed in the housing space 203 in proximity to an attachment device bottom portion 205 on the opposite side to the unit attaching portion 202. A shaft 207 is extended from each of the bomb holders 206. Each shaft 207 penetrates the attachment device bottom portion 205. A handle 208 is provided at the end of each shaft 207 outside the housing space 203. A threaded portion 209 is provided on the circumference of each shaft 207. The threaded portion 209 is screwed on the attachment device bottom portion 205. When a user rotates a handle 208, the corresponding bomb holder 206 is vertically moved. When the user stops rotating the handle 208, the bomb holder 206 does not fall and is stopped by engagement between the attachment device bottom portion 205 and the threaded portion 209. Each bomb holder 206, shaft 207, handle 208, and threaded portion 209 move the gas bomb 102 placed in the corresponding placement space 204*a* so that the following is implemented: a needle portion 217*a* (Refer to FIG. 6 and the like) is stuck into the sealing material 102*c* (Refer to FIG. 4 and the like) of the gas bomb 102. The gas bomb 102 is fixed in this state.

In this embodiment, each needle portion 217*a* is stuck into the sealing material 102*c* of a gas bomb 102 placed in a placement space 204*a* to fix the gas bomb 102. As the technology for this purpose, the technology descried in U.S. Pat. No. 7,290,539 may be adopted in place of the bomb holders 206, shafts 207, handles 208, and threaded portions 209. In this case, a panel with a roller is attached to the bomb attachment device 201 so that the panel opens/closes the housing space 203. When the panel is closed, the roller pushes a gas bomb 102 in the housing space 203. When the gas bomb 102 is pushed by the roller, the gas bomb 102 is fixed in the housing space 203 and a needle portion 217*a* is stuck into the sealing material 102*c* of the gas bomb 102.

Figure 4:
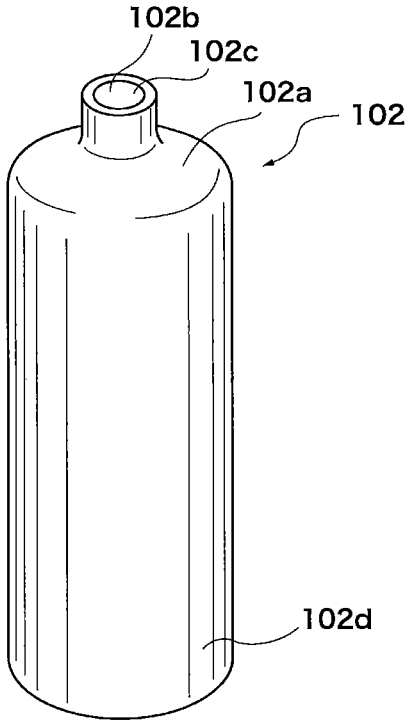
FIG. 4 is a perspective view of a gas bomb in the first embodiment.

FIG. 4 is a perspective view of a gas bomb 102. The gas bomb 102 is cylindrical. The gas bomb 102 is filled therein with compressed gas. Examples of the compressed gas include carbonic acid gas, chlorofluorocarbon gas, CFC substitute gas, and the like. The first end portion 102*a* of the gas bomb 102 located on one side is conically narrowed. A gas injection port 102*b* is provided at the tip of the first end portion 102*a*. The gas injection port 102*b* is sealed with the sealing material 102*c*. The second end portion 102*d* of the gas bomb 102 located on the other side is closed.

Figure 5:
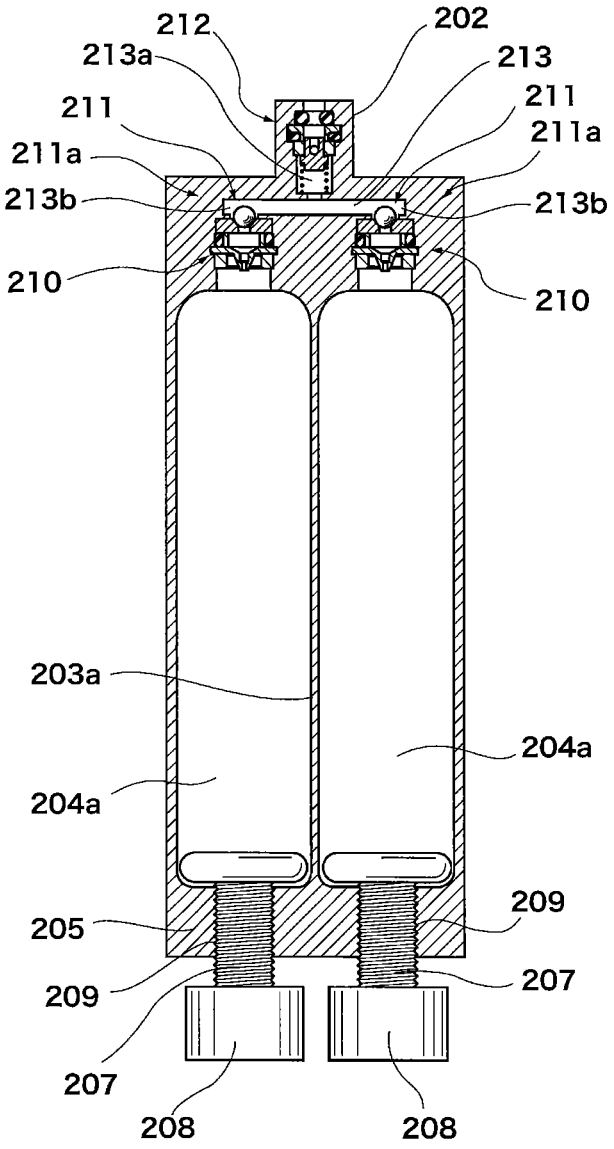
FIG. 5 is a left sectional view illustrating the internal structure of a bomb attachment device in the first embodiment.
Figure 6:
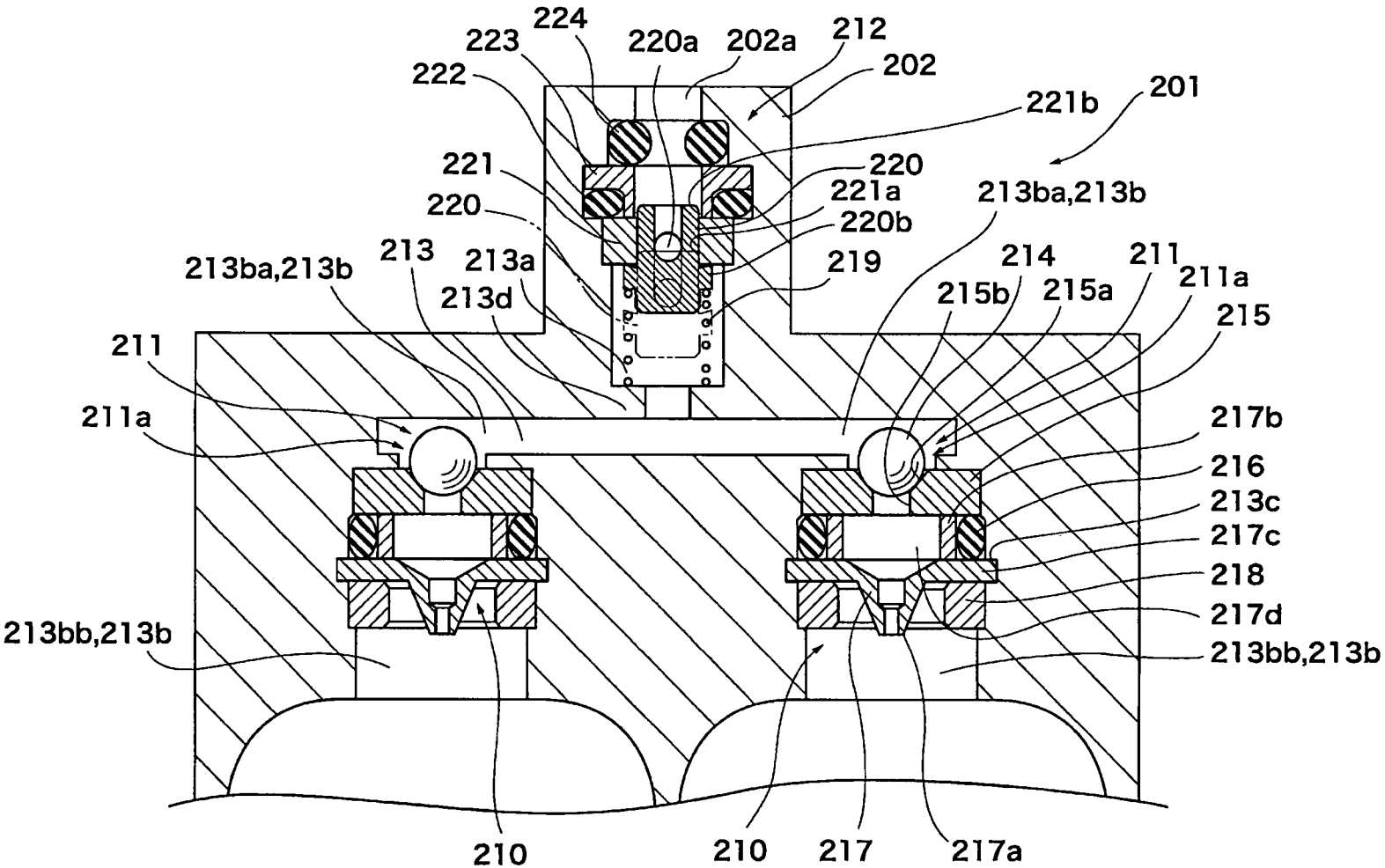
FIG. 6 is a left sectional view of a communication passage in the first embodiment.

FIG. 5 is a left sectional view illustrating the internal structure of the bomb attachment device 201. FIG. 6 is a left sectional view of a communication passage 213. FIG. 5 and FIG. 6 will be referred to. The bomb attachment device 201 includes a gas cartridge attachment portion 210, a first valve portion 211, and a second valve portion 212. In the bomb attachment device 201, the communication passage 213 is formed. In this embodiment, a gas cartridge attachment portion 210, a first valve portion 211, the unit attaching portion 202, and the second valve portion 212 are provided in the bomb attachment device 201 as a unit. For this reason, the bomb attachment device 201 can be attached to and detached from the unit attached portion 122*f* as a whole.

The communication passage 213 includes a main passage 213*a*. The main passage 213*a* is provided in the unit attaching portion 202 and is extended in the unit attaching portion 202. The main passage 213*a* is branched into two branch passages 213*b*. Each branch passage 213*b* is comprised of a first passage 213*ba* and a second passage 213*bb*. Each first passage 213*ba* is extended from the end portion of the main passage 213*a* in the direction perpendicular to the main passage 213*a*. Each second passage 213*bb* connects a first passage 213*ba* and a placement space 204*a* together.

In each branch passage 213*b*, a gas cartridge attachment portion 210 and a first valve portion 211 are placed. Hereafter, a description will be given to the gas cartridge attachment portion 210 and the first valve portion 211. The gas cartridge attachment portion 210 includes a tear part 217 (described later) and is provided at the end portion of each branch passage 213*b* on the placement space 204*a* side. The gas injection port 102*b* (Refer to FIG. 4) of a gas bomb 102 is attached to the gas cartridge attachment portion 210. Each gas cartridge attachment portion 210 is provided with a first valve portion 211. The first valve portion 211 establishes and breaks communication between the communication passage 213 and the corresponding placement space 204*a*. Each first valve portion 211 includes a check valve 211*a*. The check valve 211*a* is comprised of a valve ball 214 and a ball valve packing 215.

To each second passage 213*bb*, a valve ball 214, a ball valve packing 215, a first auxiliary packing 216, a tear part 217, and a second auxiliary packing 218 are inserted from the corresponding placement space 204*a* in this order. The valve ball 214 is perfectly spherical. In each ball valve packing 215, a receiving portion 215*a* and a through hole 215*b* are formed. The receiving portion 215*a* forms an inclined surface inclined from the through hole 215*b* and receives the valve ball 214 by this inclined surface. The through hole 215*b* is extended from the receiving portion 215*a* and penetrates the ball valve packing 215. Each tear part 217 includes a needle portion 217*a*, a holding portion 217*b*, and a fitting portion 217*c*. The needle portion 217*a* is protruded toward the corresponding placement space 204*a*. The holding portion 217*b* is protruded toward the unit attaching portion 202 and holds the ball valve packing 215. The fitting portion 217*c* is fit in a fitting groove 213*c* formed in the inner circumferential surface of the corresponding second passage 213*bb*. In each tear part 217, a vent hole 217*d* is formed. The vent hole 217*d* penetrates the corresponding needle portion 217*a* and fitting portion 217*c* and continues to the corresponding through hole 215*b*. Each first auxiliary packing 216 surrounds the outside surface of a tear part 217 and is sandwiched between a ball valve packing 215 and a fitting portion 217*c*. Each second auxiliary packing 218 sandwiches a fitting portion 217*c* between it and a first auxiliary packing 216. Each first auxiliary packing 216, tear part 217, and second auxiliary packing 218 are press fit into the corresponding second passage 213*bb* and become stationary in the second passage 213*bb*. As a result, the ball valve packing 215 is held by the holding portion 217*b* and the first auxiliary packing 216 and becomes stationary in the second passage 213*bb*. The diameter of the valve ball 214 is larger than the inside diameter of the first passage 213*ba*. For this reason, the valve ball 214 does not roll into the first passage 213*ba*.

The first valve portion 211 may include a manual valve that can be opened/closed by a user's operation in place of the check valve 211*a*.

In the main passage 213*a*, the second valve portion 212 is placed. Hereafter, a description will be given to the second valve portion 212. The second valve portion 212 is provided at some midpoint in the main passage 213*a* and establishes and breaks communication between the communication passage 213 and the external space. The second valve portion 212 includes a valve body spring 219, a valve body 220, and a valve body packing 221.

To the main passage 213*a*, the following members are inserted from an opening 202*a* open in the unit attaching portion 202 in the following order: the valve body spring 219, the valve body 220, the valve body packing 221, a third auxiliary packing 222, a press fit member 223, and a nozzle support member 224. The valve body packing 221 is slightly protruded from the third auxiliary packing 222 inward of the main passage 213*a* and forms a minute stepped portion 221*b*. In this embodiment, the valve body 220 is a columnar body long in the direction in which the main passage 213*a* is extended. A vent hole 220*a* is formed in the valve body 220. The vent hole 220*a* connects together the end face of the valve body 220 on the opening 202*a* side and the side surface of the valve body 220. A flange portion 220*b* is protruded in the side surface of the valve body 220 between the opening of the vent hole 220*a* and the branch passages 213*b*. The valve body spring 219 is positioned between the flange portion 220*b* and the spring receiving portion 213*d* and pushes the valve body 220 toward the opening 202*a*. The spring receiving portion 213*d* is provided at the boundary between the main passage 213*a* and the branch passages 213*b* and is jutted inward of the communication passage 213. The valve body packing 221 forms a through hole 221*a* into which the valve body 220 gets. The flange portion 220*b* of the valve body 220 pushed by the valve body spring 219 is pressed against the valve body packing 221. The third auxiliary packing 222, press fit member 223, and nozzle support member 224 prevent the movement of the valve body packing 221 toward the opening 202*a*. The opening of the vent hole 220*a* appearing in the side surface of the valve body 220 is in contact with the inner circumferential surface of the through hole 221*a*. As a result, the main passage 213*a* is interrupted.

Figure 7:
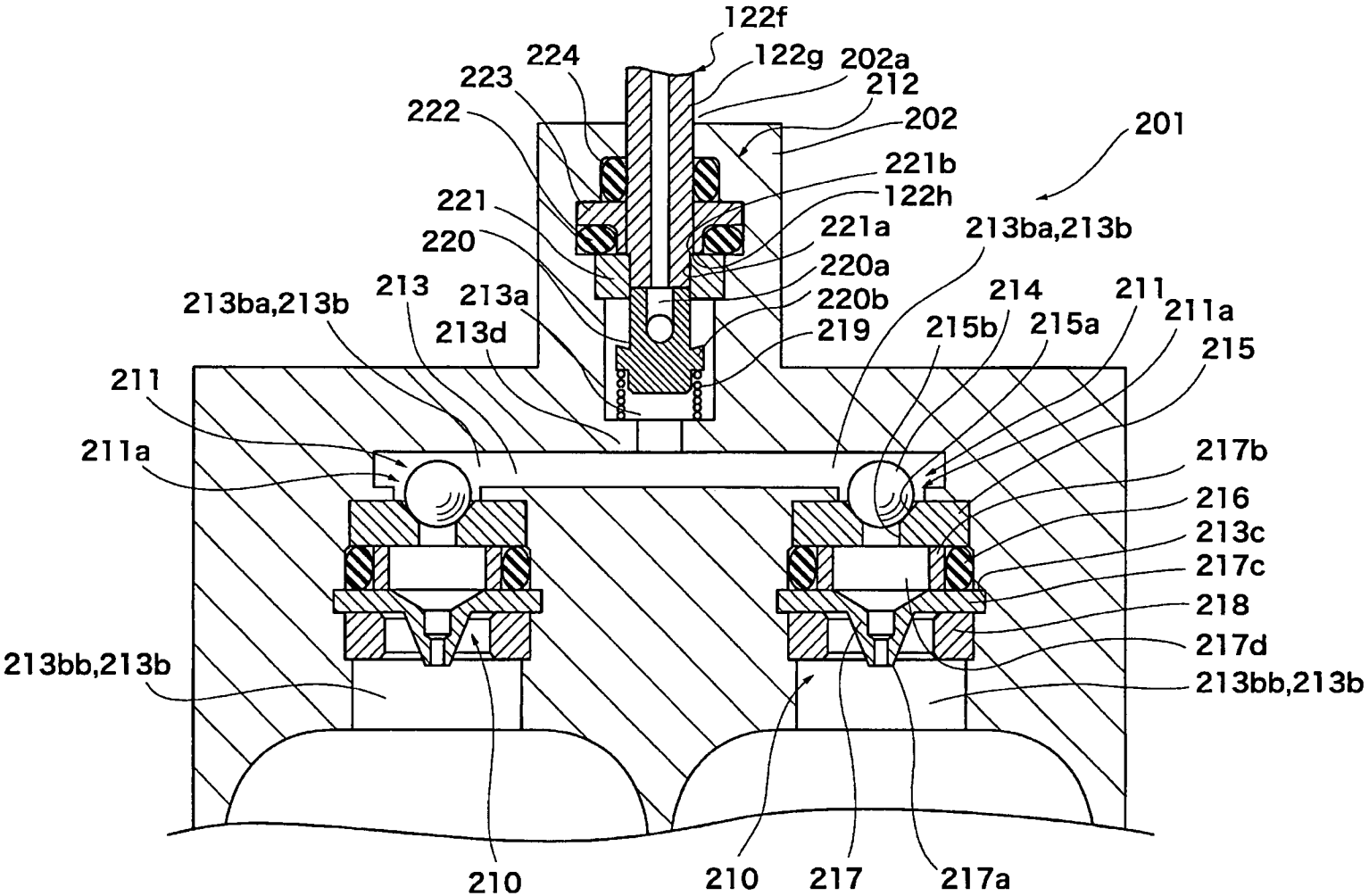
FIG. 7 is a left sectional view of a communication passage in the first embodiment with a unit attached portion attached.

FIG. 7 is a left sectional view of the communication passage 213 with the unit attached portion 122*f* attached thereto. FIG. 7 and FIG. 2 will be referred to. The unit attached portion 122*f* has a nozzle 122*g*. (Refer to FIG. 2.) The nozzle 122*g* communicates with the gas introduction passage 122*e*. The circumference of the tip of the nozzle 122*g* is slightly recessed and a minute stepped portion 122*h* is formed there. The nozzle 122*g* is inserted from the opening 202*a* into the main passage 213*a*. The nozzle support member 224 holds the side surface of the inserted nozzle 122*g* to fill the gap between the nozzle support member 224 and the nozzle 122*g*. As a result, the internal space of the inserted nozzle 122*g* and the vent hole 220*a* of the valve body 220 communicate with each other. Then the tip of the inserted nozzle 122*g* moves the valve body 220 toward the branch passages 213*b*. At this time, the minute stepped portion 221*b* of the valve body packing 221 and the minute stepped portion 122*h* of the nozzle 122*g* are engaged with each other. As a result, the valve body 220 pushed by the nozzle 122*g* does not bump into the spring receiving portion 213*d*. This prevents the valve body spring 219 from being compressed to interrupt the main passage 213*a*. As a result, the internal space of the nozzle 122*g*, the vent hole 220*a*, and the main passage 213*a* communicate with one other. In FIG. 6, the valve body 220 moved by the nozzle 122*g* is depicted by alternate long and short dash line. When the nozzle 122*g* is withdrawn from the main passage 213*a*, the valve body spring 219 pushes the valve body 220 toward the opening 202*a* and interrupts the main passage 213*a*.

Figure 8:
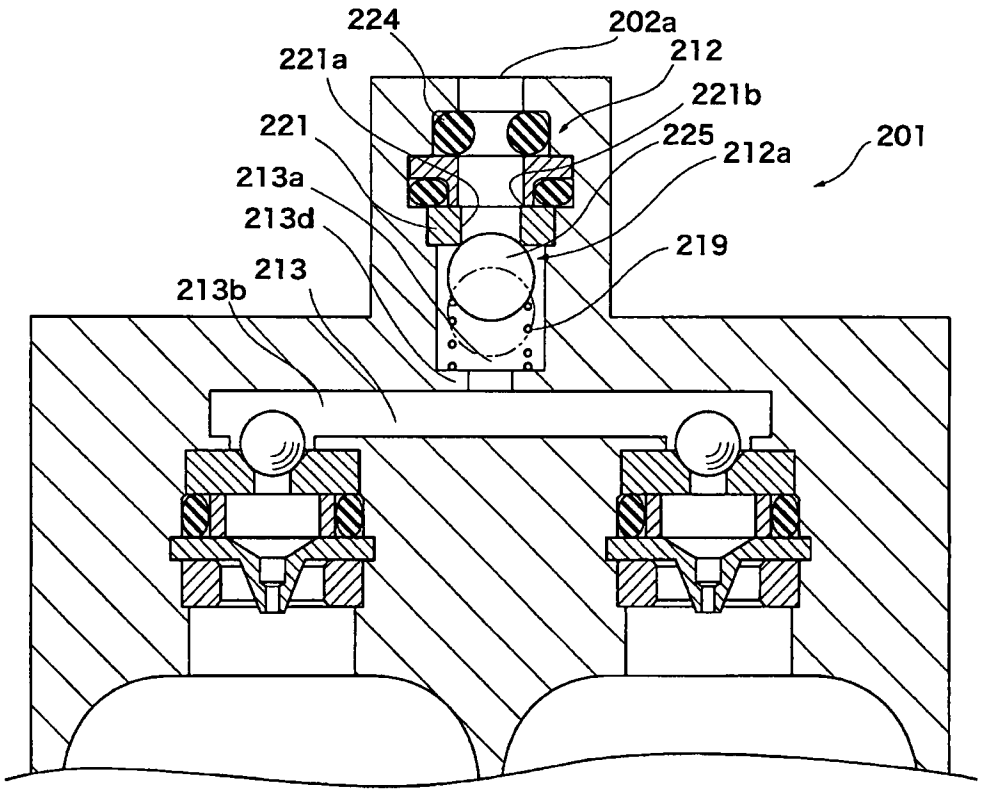
FIG. 8 is a left sectional view of a communication passage shown as a modification to the first embodiment.

A description will be given to a modification to the second valve portion 212 with reference to FIG. 8 and FIG. 9. FIG. 8 is a left sectional view of the communication passage 213. The second valve portion 212 includes a check valve 212*a*. The check valve 212*a* is comprised of a valve ball 225 and the valve body packing 221. The valve ball 225 is placed in place of the valve body 220 and is perfectly spherical. The valve ball 225 is pushed toward the opening 202*a* by the valve body spring 219 and the pressure of compressed gas in the communication passage 213 and is pressed against the edge portion of the through hole 221*a*. As a result, the main passage 213*a* is interrupted.

Figure 9:
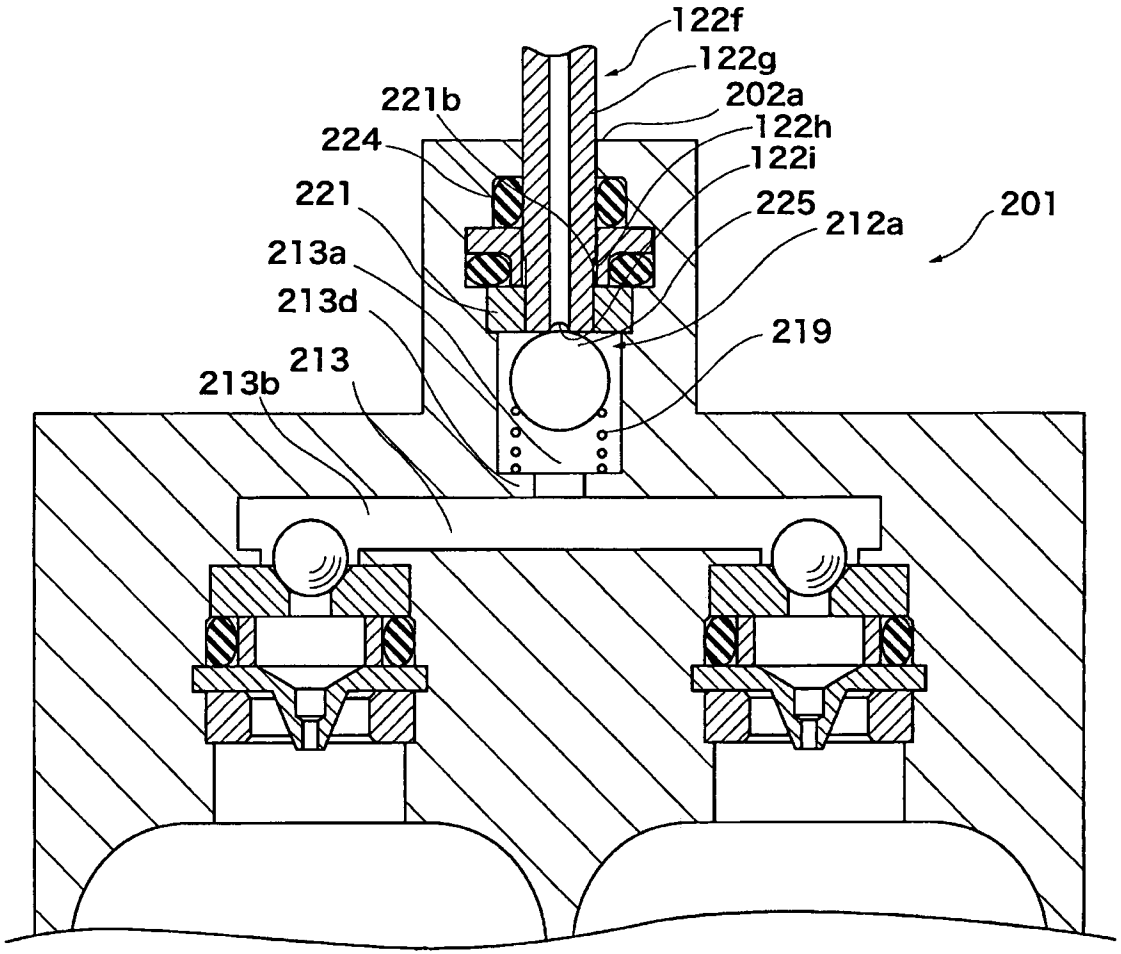
FIG. 9 is a left sectional view of a communication passage with a unit attached portion attached, shown as a modification to the first embodiment.

FIG. 9 is a left sectional view of the communication passage 213 with the unit attached portion 122*f* attached thereto. In this modification, a cutout 122*i* is formed at the tip of the nozzle 122*g*. When the nozzle 122*g* is inserted from the opening 202*a* into the main passage 213*a*, the gap between the nozzle support member 224 and the nozzle 122*g* is filled. Then the tip of the inserted nozzle 122*g* moves the valve ball 225 toward the branch passages 213*b*. As a result, the internal space of the nozzle 122*g* and the main passage 213*a* communicate with each other. At this time, the presence of the cutout 122*i* makes communication between the internal space of the nozzle 122*g* and the main passage 213*a* reliable. The minute stepped portion 221*b* of the valve body packing 221 and the minute stepped portion 122*h* of the nozzle 122*g* are engaged with each other. As a result, the valve ball 225 pushed by the nozzle 122*g* does not bump into the spring receiving portion 213*d*. This prevents the valve body spring 219 from being compressed to interrupt the main passage 213*a*. In FIG. 8, the valve ball 225 moved by the nozzle 122*g* is depicted by alternate long and short dash line. When the nozzle 122*g* is withdrawn from the main passage 213*a*, the valve body spring 219 pushes the valve ball 225 toward the opening 202*a* and interrupts the main passage 213*a*.

When attention is paid to that the valve ball 225 shown in FIG. 8 and FIG. 9 is pushed by the pressure of compressed gas in the communication passage 213 and is pressed against the valve body packing 221, the valve body spring 219 need not be provided. However, the presence of the valve body spring 219 implements the following: when the nozzle 122*g* is withdrawn from the main passage 213*a*, the valve ball 225 quickly moves to the opening 202*a* and the main passage 213*a* is immediately interrupted.

An inclined surface inclined from the through hole 221*a* may be formed in the valve body packing 221 at the point of contact with the valve ball 225 like the receiving portions 215*a* shown in FIG. 6 and FIG. 7.

Figure 10:
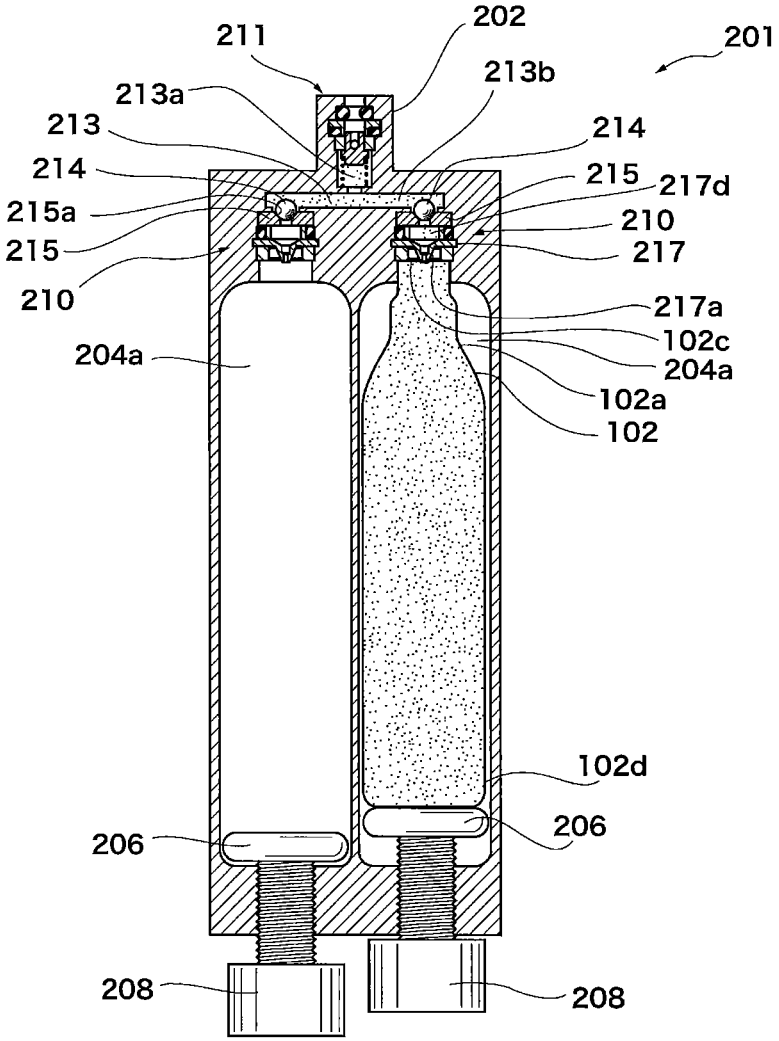
FIG. 10 is a left sectional view of a bomb attachment device in the first embodiment with a gas bomb attached to only one gas cartridge attachment portion.

The description will be back to the first embodiment. FIG. 10 is a left sectional view of the bomb attachment device 201 with a gas bomb 102 attached to only one gas cartridge attachment portion 210. In FIG. 10, the areas filled with compressed gas are filled with dots. A user inserts the gas bomb 102 from the gas bomb introduction port 204 (Refer to FIG. 1) into a placement space 204*a*. At this time, the first end portion 102*a* is brought close to the corresponding gas cartridge attachment portion 210 and the second end portion 102*d* is brought close to the corresponding bomb holder 206. Subsequently, the user rotates the corresponding handle 208 so that the bomb holder 206 is moved toward the gas cartridge attachment portion 210. As a result, the needle portion 217*a* of the corresponding tear part 217 is stuck into the sealing material 102*c* of the gas bomb 102. (Refer to FIG. 4 as well.) Then compressed gas in the gas bomb 102 spouts out and gets into the corresponding vent hole 217*d* and brings the valve ball 214 away from the ball valve packing 215. As a result, the compressed gas passes through the corresponding branch passage 213*b* and flows into the main passage 213*a* and increases the pressure in the communication passage 213 at a dash.

In the gas cartridge attachment portion 210 without a gas bomb 102 attached thereto (the left gas cartridge attachment portion 210 in FIG. 10), the following takes place: the valve ball 214 is pushed by the pressure in the communication passage 213 and is pressed against the receiving portion 215*a* of the corresponding ball valve packing 215. For this reason, the compressed gas does not leak from the gas cartridge attachment portion 210 without a gas bomb 102 attached thereto.

At the second valve portion 212, the valve body spring 219 pushes the valve body 220 and the main passage 213*a* is interrupted. For this reason, the compressed gas does not leak from the unit attaching portion 202, either.

Figure 11:
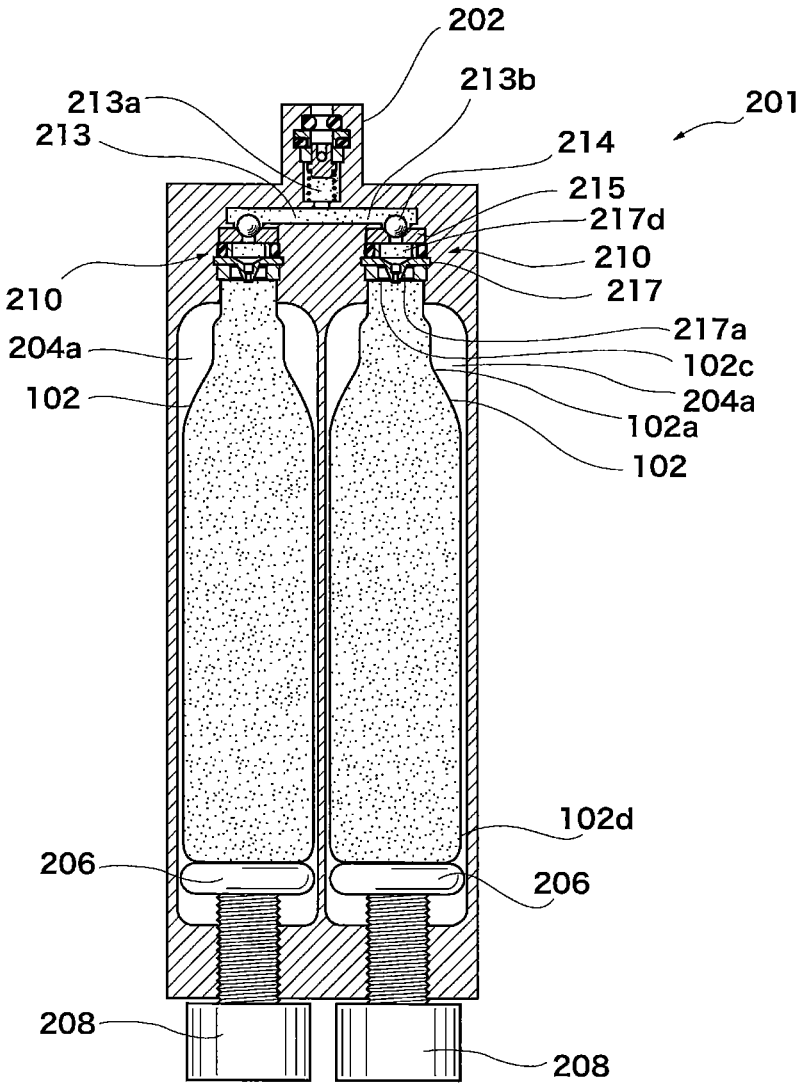
FIG. 11 is a left sectional view of a bomb attachment device in the first embodiment with a gas bomb attached to every gas cartridge attachment portion.

FIG. 11 is a left sectional view of the bomb attachment device 201 with a gas bomb 102 attached to every gas cartridge attachment portion 210. In FIG. 11, the areas filled with compressed gas are filled with dots. A user attaches a gas bomb 102 also to a gas cartridge attachment portion 210 without a gas bomb 102 attached thereto in accordance with the same procedure. As a result, compressed gas gets into the communication passage 213 from both the gas cartridge attachment portions 210.

Figure 12:
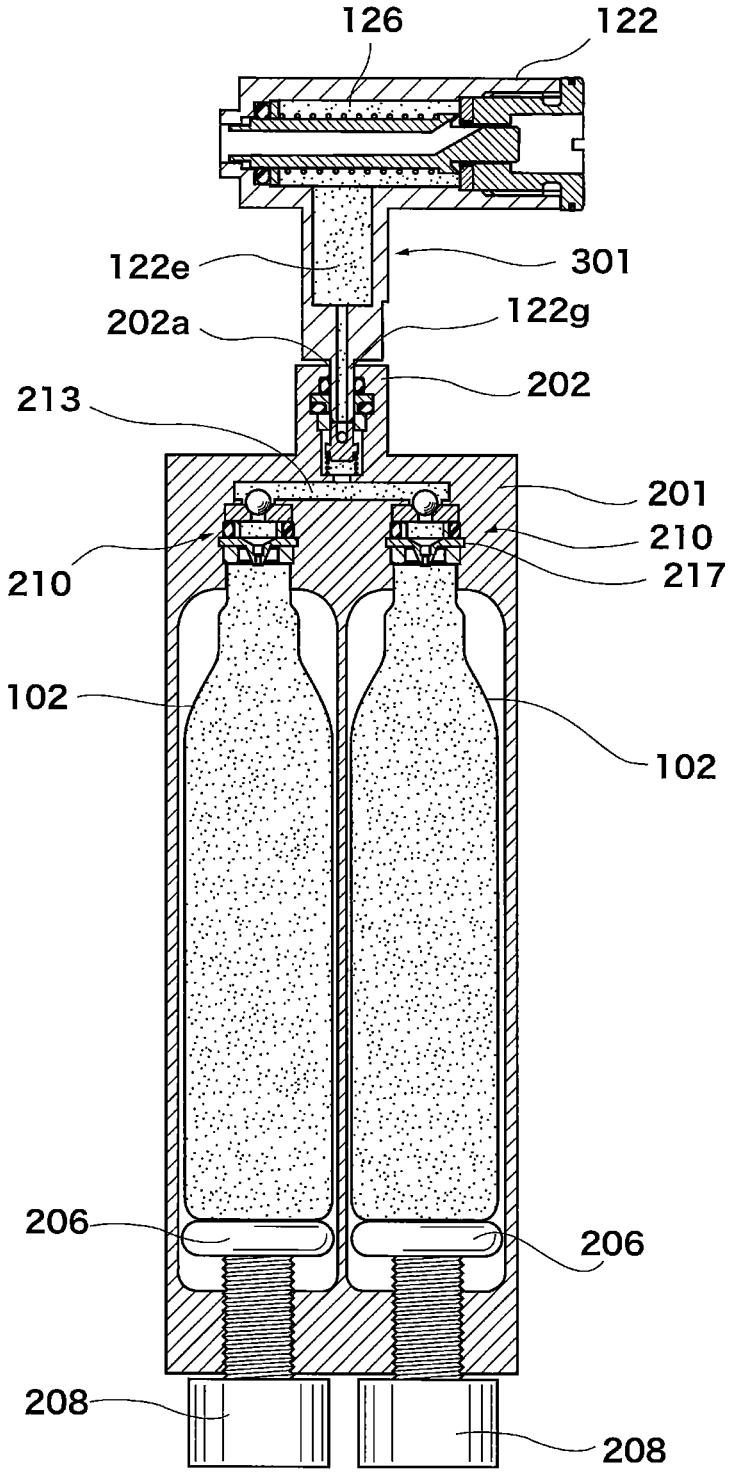
FIG. 12 is a left sectional view of a bomb attachment device, coupled to an air chamber body, in the first embodiment with a gas bomb attached to every gas cartridge attachment portion.

FIG. 12 is a left sectional view of the bomb attachment device 201 with a gas bomb 102 attached to every gas cartridge attachment portion 210 as is coupled to the air chamber body 122. In FIG. 12, the areas filled with compressed gas are filled with dots. A user inserts the nozzle 122*g* provided in the air chamber body 122 into the opening 202*a* of the unit attaching portion 202. As a result, the gas introduction passage 122*e* in the air chamber body 122 and the communication passage 213 in the bomb attachment device 201 communicate with each other. A gas introduction portion 301 for guiding compressed gas from the gas bomb attached to each gas cartridge attachment portion 210 into the air chamber 126 is formed. In this embodiment, as mentioned above, the gas introduction portion 301 can be freely coupled or decoupled by the unit attached portion 122*f* and the unit attaching portion 202. A user moves the trigger 105 (Refer to FIG. 1 and the like) to shoot a bullet B (Refer to FIG. 1 and the like) out of the muzzle 103 (Refer to FIG. 1 and the like) of the toy gun 101. Each time this occurs, compressed gas is supplied from the gas bombs 102 through the gas introduction portion 301 and is filled in the air chamber 126.

Figure 13:
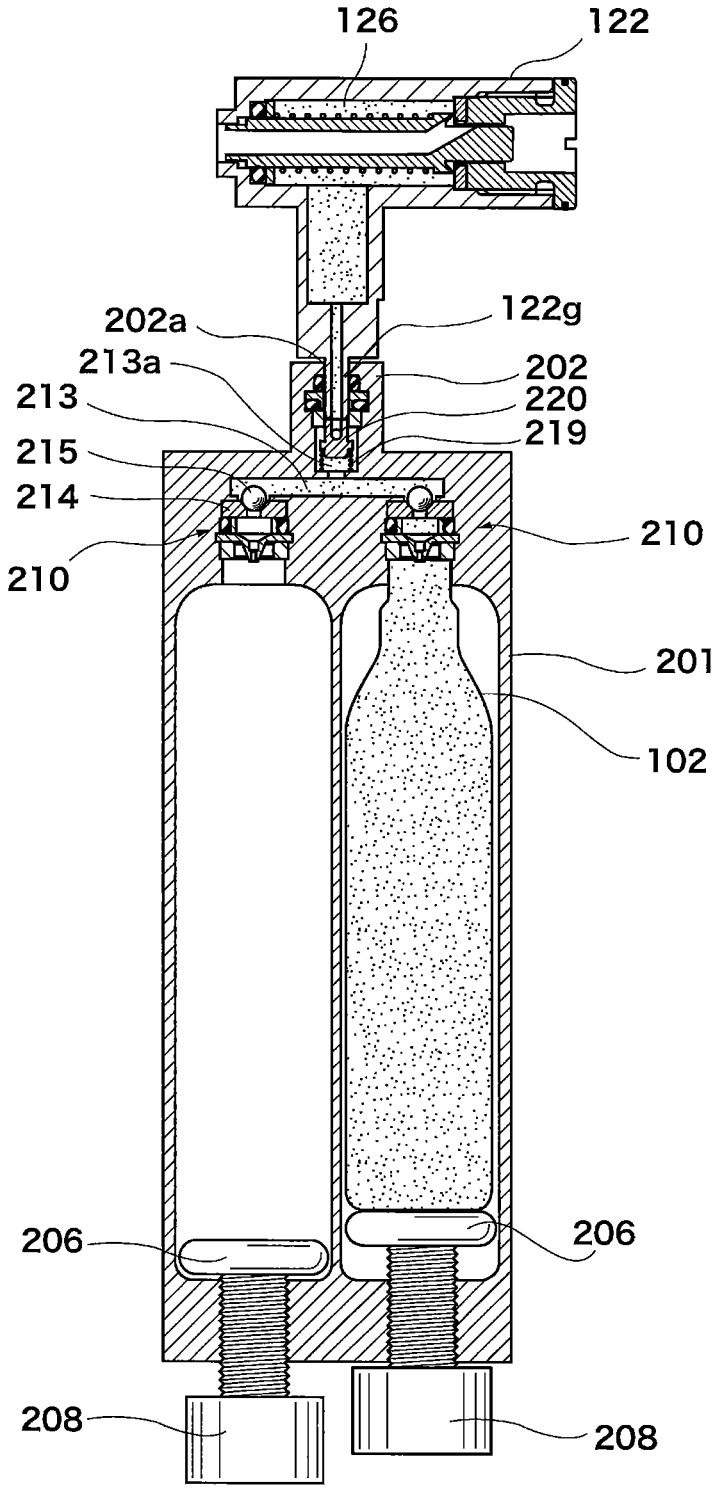
FIG. 13 is a left sectional view of a bomb attachment device, coupled to an air chamber body, in the first embodiment with a gas bomb attached to only one gas cartridge attachment portion.

FIG. 13 is a left sectional view of the bomb attachment device 201 with a gas bomb 102 attached to only one gas cartridge attachment portion 210 as is coupled to the air chamber body 122. In FIG. 13, the areas filled with compressed gas are filled with dots. Even when the bomb attachment device 201 with a gas bomb 102 attached to only one gas cartridge attachment portion 210 as in FIG. 10 is coupled to the air chamber body 122, the user can use the toy gun 101 without problems. This is because compressed gas does not leak from a gas cartridge attachment portion 210 without a gas bomb 102 attached thereto as mentioned above. Even when a user attaches the bomb attachment device 201 with a gas bomb 102 attached to every gas cartridge attachment portion 210 to the toy gun 101 and thereafter removes one gas bomb 102, the following does not take place: compressed gas does not leak from a gas cartridge attachment portion 210 without a gas bomb 102 attached thereto.

When a user removes the bomb attachment device 201 from the nozzle 122*g*, the valve body spring 219 pushes the valve body 220 toward the opening 202*a* and the main passage 213*a* is interrupted. As a result, compressed gas in a gas bomb 102 does not leak from the opening 202*a*.

In the toy gun 101 in this embodiment, as mentioned above, multiple gas bombs 102 can be attached. Each gas cartridge attachment portion 210 can be closed by the first valve portion 211. For this reason, not a large-sized gas bomb 102, multiple small-sized gas bombs 102 can be used to use the toy gun 101. Therefore, the toy gun 101 can be used without the replacement of a gas bomb 102 for a long time. At the same time, the portability of the gas bomb 102 is enhanced. In addition, since the gas bomb 102 can be reduced in size, the toy gun 101 can be flexibly designed. As the result of a first valve portion 211 being closed, bullets B can be shout out of the toy gun 101 just by attaching one gas bomb 102 to the bomb attachment device 201.

In the toy gun 101 in this embodiment, each first valve portion 211 includes a check valve 211*a*. For this reason, when a user attaches or detaches a gas bomb 102, he/she need not open or close the first valve portion 211.

In the toy gun 101 in this embodiment, the bomb attachment device 201 is provided with the gas cartridge attachment portions 210, first valve portions 211, unit attaching portion 202, and second valve portion 212 as a unit. For this reason, the usability of the bomb attachment device 201 is enhanced.

In the toy gun 101 in this embodiment, compressed gas does not leak even when the bomb attachment device 201 is removed from the nozzle 122*g* or some gas bombs 102 are removed from the bomb attachment device 201. For this reason, it is possible to remove the bomb attachment device 201 from the nozzle 122*g* and use a gas bomb 102 attached to the bomb attachment device 201 later. It is also possible to attach the bomb attachment device 201 removed with a gas bomb 102 attached thereto to a different toy gun 101.

A description will be given to another embodiment with reference to FIG. 14. This embodiment will be designated as second embodiment for convenience of explanation. In this case, the same parts as in the first embodiment will be marked with the same reference numerals and the description thereof will be omitted.

Figure 14:
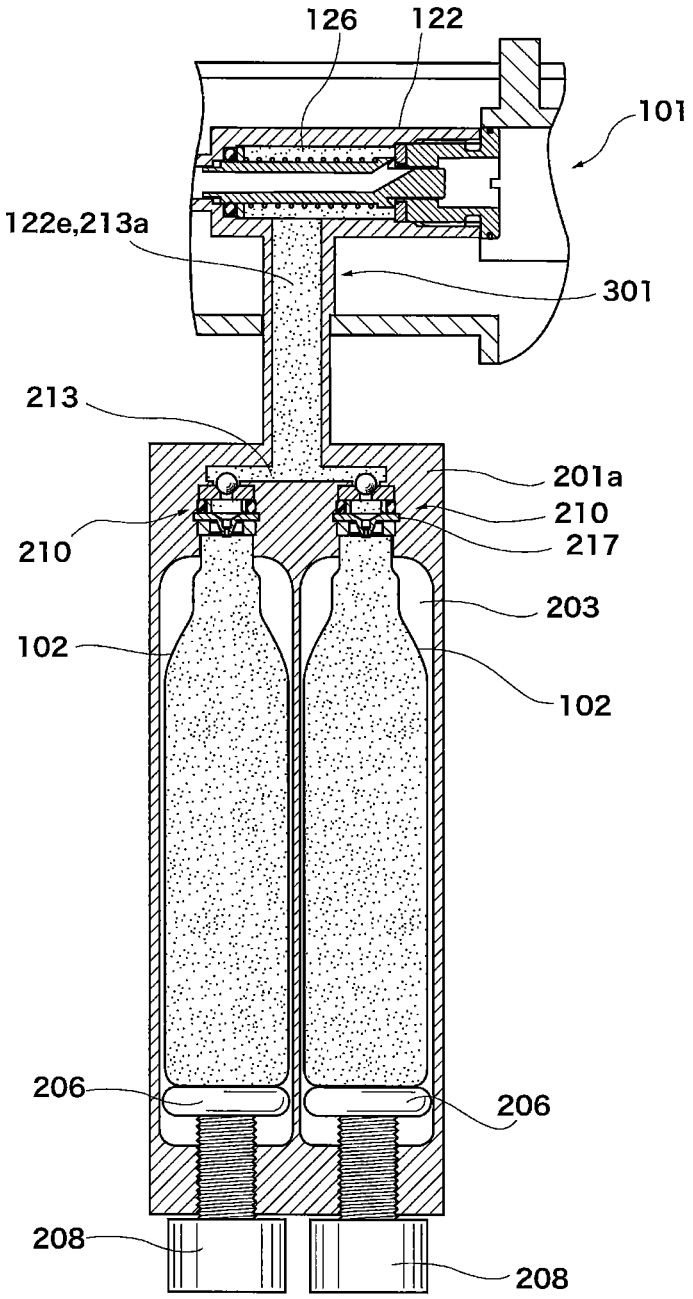
FIG. 14 is a left sectional view of a toy gun in a second embodiment with all the gas cartridge attachment portions attached.

FIG. 14 is a left sectional view of the toy gun 101 with a gas bomb attached to every gas cartridge attachment portion 210. In FIG. 14, the areas filled with compressed gas are filled with dots. In this embodiment, an element corresponding to the bomb attachment device 201 in the first embodiment is integrally formed in the air chamber body 122. That is, a gas bomb attachment portion 201*a* is extended downward from the air chamber body 122 in this embodiment. In the gas bomb attachment portion 201*a*, a housing space 203 is formed and the elements, such as the gas cartridge attachment portion 210 and the first valve portion 211, provided in the bomb attachment device 201 are housed there. In this embodiment, the toy gun 101 is not provided with the second valve portion 212. (Refer to FIG. 6 and the like.) The gas introduction passage 122*e* and the main passage 213*a* are in common. The toy gun 101 is not provided with the spring receiving portion 213*d* (Refer to FIG. 6) positioned at the boundary between the main passage 213*a* and the branch passages 213*b*, either.

Also in the toy gun 101 in this embodiment, multiple small-sized gas bombs 102 can be used as in the toy gun in the first embodiment. Therefore, the toy gun 101 can be used without the replacement of a gas bomb 102 for a long time. At the same time, the portability of the gas bomb 102 is enhanced. In the toy gun 101 in this embodiment, in addition, the bomb attachment device 201 (Refer to the description of the first embodiment) will not be lost because the air chamber body 122 or the gas bomb attachment portion 201*a* is not separated from each other.

A description will be given to another embodiment with reference to FIG. 15 and FIG. 16. This embodiment will be designated as third embodiment for convenience of explanation. This embodiment is based on the second embodiment. In this case, the same parts as in the second embodiment will be marked with the same reference numerals and the description thereof will be omitted.

Figure 15:
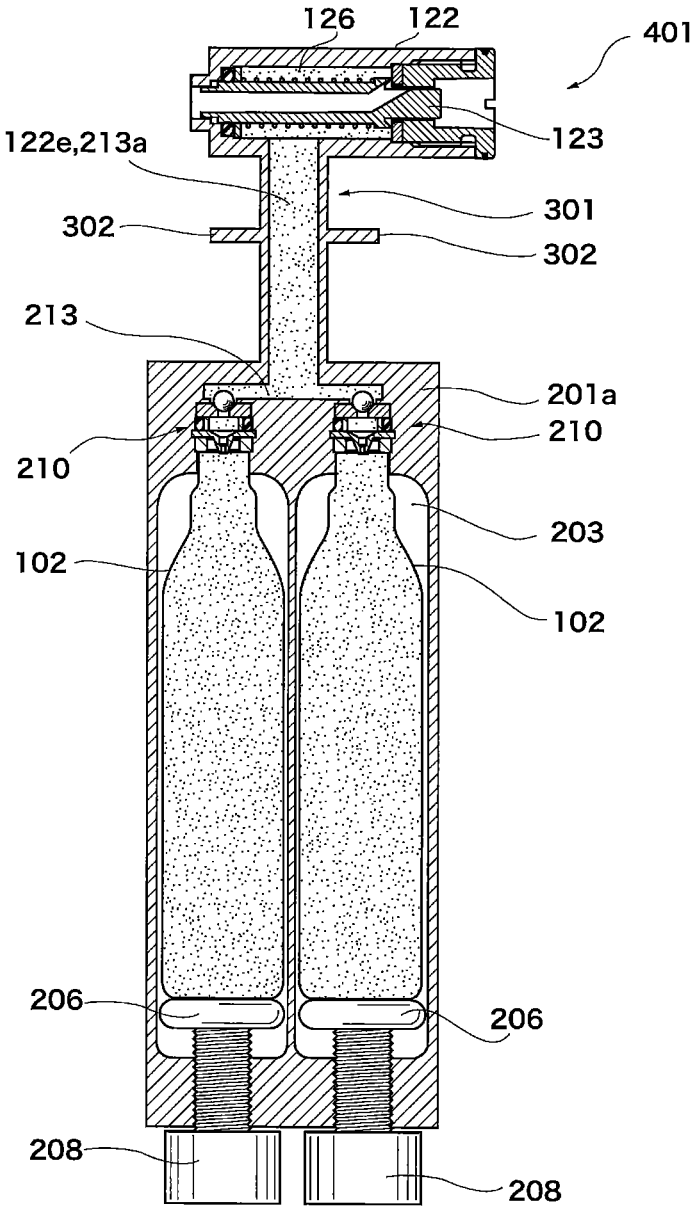
FIG. 15 is a left sectional view of a bomb unit in a third embodiment.

FIG. 15 is a left sectional view of a bomb unit 401. In this embodiment, the air chamber body 122, gas introduction portion 301, gas cartridge attachment portions 210, first valve portions 211, and valve 123 are unitized as the bomb unit 401. The bomb unit 401 is equivalent to "attachment device" in WHAT IS CLAIMED IS. The bomb unit 401 can be freely attached to and detached from the frame 111. The configuration of the bomb unit 401 is the same as the configuration of the air chamber body 122 in the second embodiment. That is, the bomb unit 401 includes the air chamber body 122 formed by extending the gas bomb attachment portion 201*a* and the valve 123 housed in the air chamber body 122. A flange portion 302 is extended from the side surface of the gas introduction portion 301.

Figure 16:
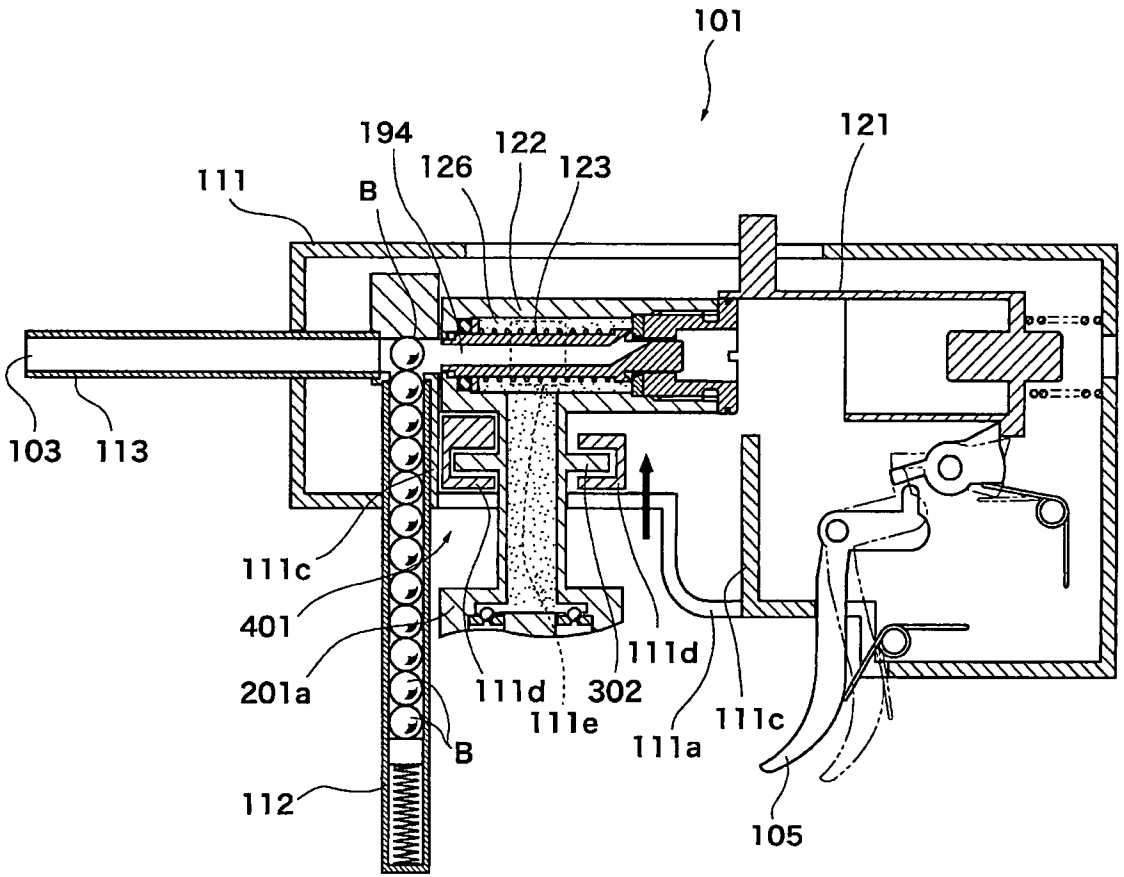
FIG. 16 is a left sectional view of a toy gun in the third embodiment.

FIG. 16 is a left sectional view of the toy gun 101. The lower surface of the frame 111 is provided with a slot 111*a* for inserting the bomb unit 401 from below. A guide portion 111*c* is extended from the edge of the slot 111*a* inward of the frame 111. The guide portion 111*c* guides the bomb unit 401.

A stopper 111*d* is provided on a side surface of the frame 111. The stopper 111*d* can be freely slid in the left-right direction of the toy gun 101 and a user can move the stopper. The stopper 111*d* holds the flange portion 302 of the bomb unit 401 inserted from the slot 111*a* and prevents the bomb unit 401 from being moved in the vertical direction. As illustrated in FIG. 16, the upper surface of the front part of the stopper 111*d* can support the lower surface of the front end portion of the air chamber body 122.

A holding protrusion 111*e* is protruded from the left and right inside surfaces of the frame 111. The holding protrusions 111*e* clamp the left and right side surfaces of the air chamber body 122 to prevent the bomb unit 401 from being moved in the left-right direction of the toy gun 101. The bolt 121 is formed in such a shape that the bolt is not interfered with by the holding protrusions 111*e*.

A user holds the bomb unit 401 with a gas bomb 102 attached to the gas bomb attachment portion 201*a* and inserts the air chamber body 122 of the bomb unit 401 upward from the slot 111*a*. The air chamber body 122 is guided by the guide portion 111*c* and positioned in a position where the barrel 113 and the valve 123 are coaxially aligned with each other. At this time, the air chamber body 122 is sandwiched between the holding protrusions 111*e*. The user subsequently moves the stopper 111*d* to cause the stopper 111*d* holds the flange portion 302. When the user moves the trigger 105 in this state, the bolt 121 advances and the abutment portion 121*e* (Refer to FIG. 2, FIG. 3, and the like) pushes the sliding protrusion 123*b* (Refer to FIG. 2, FIG. 3, and the like). Compressed gas in the air chamber 126 passes through the gas discharge portion 194 and pushes a bullet B. As a result, the bullet B is shot out of the muzzle 103.

Also in the toy gun 101 in this embodiment, multiple small-sized gas bombs 102 can be used as in the toy gun in the first embodiment. Therefore, the toy gun 101 can be used without the replacement of a gas bomb 102 for a long time. At the same time, the portability of the gas bomb 102 is enhanced. In the toy gun 101 in this embodiment, in addition, the air chamber body 122 can be replaced. The air chamber body 122 includes the air chamber 126 and valve 123 important for firing bullets B. For this reason, a user can replace the bomb unit 401 to enjoy various types of the feeling of shooting through the toy gun 101.

Figure 17:
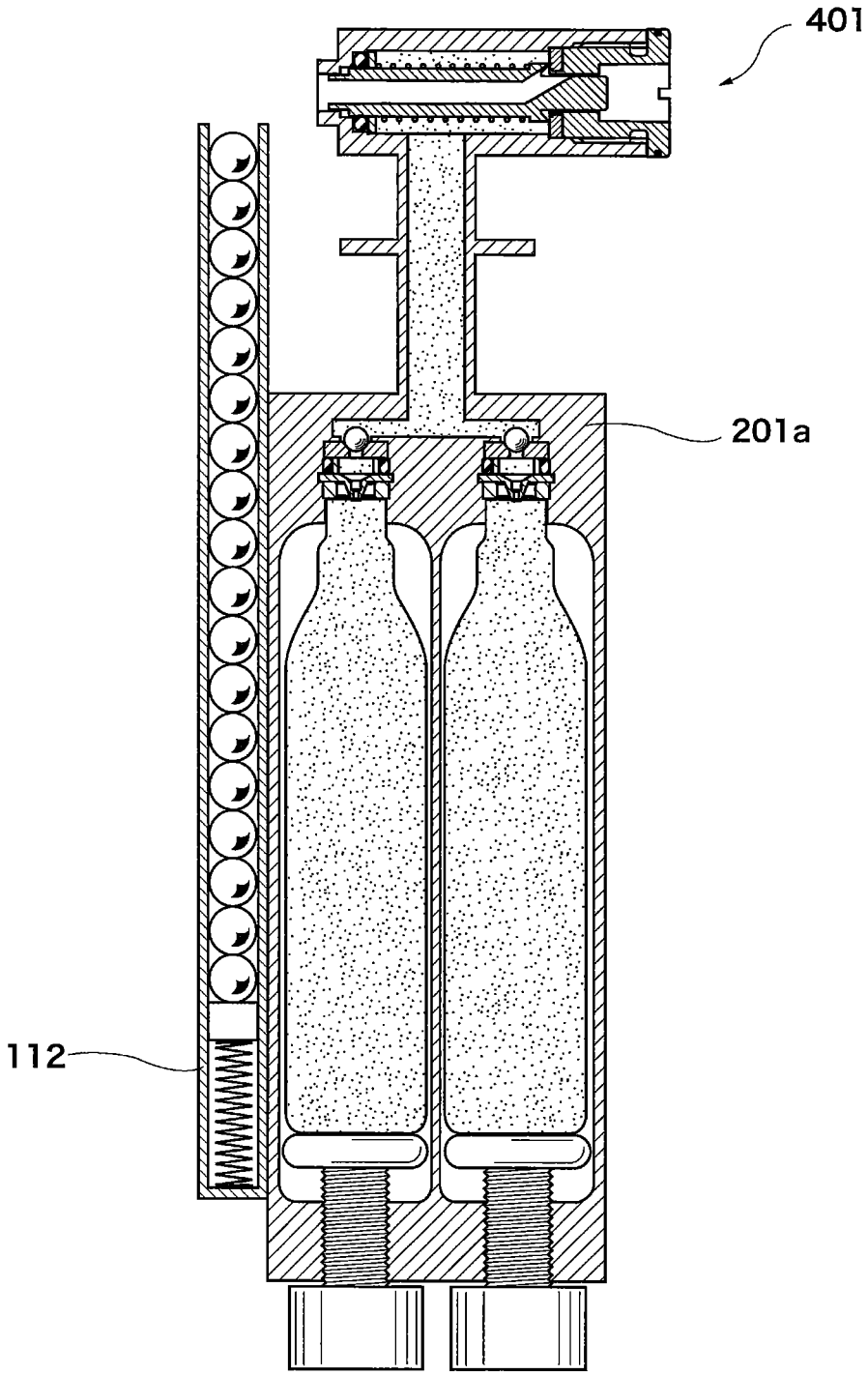
FIG. 17 is a left sectional view of a bomb unit shown as a modification to the third embodiment.

As a modification to the third embodiment, the magazine 112 may be attached to a side surface of the gas bomb attachment portion 201*a* of the bomb unit 401 as illustrated in FIG. 17.

In the third embodiment and the modification thereto, the flange portion 302 (Refer to FIG. 15, FIG. 16, and the like) and the stopper 111*d* (Refer to FIG. 16 and the like) are used for the following purpose: to fix or release the bomb unit 401 to or from the frame 111. Instead, the bomb unit may be fixed to or released from the frame 111 as follows:

A description will be given to an example of a method for fixing and releasing the bomb unit 401 to and from the frame 111. The frame 111 is provided with a magazine release portion having a groove extended in the left-right direction. The bomb unit 401 inserted from the slot 111*a* is engaged with the groove. When the magazine release portion is moved, the groove and the bomb unit 401 are disengaged from each other and the magazine 112 becomes removable.

A description will be given to another example of a method for fixing and releasing the bomb unit 401 to and from the frame 111. A magazine catch having a tab portion and an operation lever portion is coupled to the frame 111. The tab portion of the magazine catch can freely advance or retreat to or from the lower surface of the valve 123 and supports the lower surface of the valve 123. The magazine catch is pushed by a spring and the like so that the tab portion gets into under the lower surface of the valve 123. When a user moves the operation lever portion, the tab portion retreats from the lower surface of the valve 123 and the bomb unit 401 can be freely inserted into or withdrawn from the slot 111*a*. When the user releases the operation lever portion, the tab portion moves and supports the lower surface of the valve 123. As a result, the bomb unit 401 is fixed on the frame 111.

In any of the first to third embodiments, the toy gun 101 is of rapid firing type and continuously fires bullets B as long as the trigger 105 is pulled. However, the invention is also applicable to single firing toy guns and burst toy guns, needless to add.

In any of the first to third embodiments and the modifications thereto, a gas bomb 102 is positioned ahead of the trigger 105. However, the invention is also applicable to the following toy guns, needless to add: toy guns in which the place of attachment of the bomb attachment device 201 or the bomb unit 401 is provided behind the trigger 105 so that a gas bomb 102 can be positioned behind the trigger 105.

The portions specifically described in relation to each embodiment and a modification thereto can be appropriately combined in other embodiments and modifications thereto, needless to add.

What is claimed is:

1. A toy gun comprising:

a gun frame;

a muzzle fixedly connected to the frame and sized for receiving a bullet to be discharged in a bullet discharge direction;

a bullet holding portion disposed in communication with the muzzle and for holding the bullet;

an air chamber body forming an air chamber for temporarily storing compressed gas therein and fixedly connected to the gun frame;

a tubular valve disposed in the air chamber and operative to move in the bullet discharge direction to establish fluid communication between the air chamber and the bullet holding portion and to move in a reverse bullet discharge direction being opposite of the bullet discharge direction to break fluid communication between the air chamber and the bullet holding portion, the tubular valve resiliently biased in the reverse bullet discharge direction to fluidically isolate the air chamber and the bullet holding portion; a bolt member having a bolt member body defining a hollow sleeve sized to slidably receive at least a portion of the air chamber body;

a plurality of gas cartridge attachment portions to which a respective one of a plurality of gas cartridges for supplying compressed gas is attached;

a plurality of first valve portions with a respective one of the plurality of first valve portions provided in and operably connected to each respective one of the gas cartridge attachment portions; and a gas introduction portion guiding compressed gas from the respective ones of the gas cartridges attached to each of the gas cartridge attachment portions into the air chamber, wherein the valve is disposed downstream of the plurality of the first valve portions and wherein the bolt member moves to and between a bullet discharge-ready position and a bullet discharge position such that, in the bullet discharge-ready position, the hollow sleeve is devoid of and disposed rectilinearly away from the air chamber body and the tubular valve in the reverse bullet direction and, in the bullet discharge position, the bolt member is rectilinearly moved in the bullet discharge direction to envelop the air chamber body and impact the tubular valve and, upon impact with the tubular valve, the tubular valve moves in the bullet discharge direction causing the air chamber and the bullet holding portion to fluidically communicate with one another;

an attachment device for conveying compressed gas from the pair of gas cartridges disposed therein, including:

a hollow container extending along a longitudinal axis and having an internal space sized to receive the pair of gas cartridges therein, the hollow container having a gas delivery end portion and a cartridge holding end portion disposed longitudinally opposite the gas delivery end portion, the gas delivery end portion including a gas cartridge attachment portion defining a to of the hollow container and a unit attaching portion integrally connected to the gas cartridge attachment portion and projecting from the to of the hollow container and extending centrally along and about the longitudinal axis, the gas cartridge attachment portion and the unit attaching portion formed with a gas passageway having an attaching portion passageway segment extending along and about the longitudinal axis, through the unit attaching portion and partially into the gas cartridge attachment portion, a pair of gas cartridge attachment passageway segments disposed apart from one another and extending parallel to the longitudinal axis and a connector passageway segment extending perpendicularly to the longitudinal axis and interconnecting the attaching portion passageway segment and the pair of gas cartridge attachment passageway segments;

a pair of gas cartridge valves with a respective one of the pair of gas cartridge valves disposed in a respective one of the pair of gas cartridge attachment passageway segments, respective ones of the pair of gas cartridge valves operative to contact and fluidically communicate with respective ones of the pair of gas cartridges; and a unit attaching valve disposed in at least the attaching portion passageway segment and operative, when the pair of gas cartridge valves contact and fluidically communicate with the respective ones of the pair of gas cartridges, to either retain the compressed gas within the hollow container or allow the compressed gas to discharge therefrom.

2. The toy gun according to claim 1, wherein each of the first valve portions includes a check valve.

3. The toy gun according to claim 1 or 2, wherein the gas introduction portion includes: a unit attached portion provided on the air chamber side; and a unit attaching portion that is provided on the gas cartridge attachment portion side and can be freely attached to and detached from the unit attached portion, and can be freely coupled and decoupled, wherein the unit attaching portion is provided with a second valve portion, and wherein the gas cartridge attachment portions, the first valve portions, the unit attaching portion, and the second valve portion are configured as a unit and can be attached and detached as a whole.

4. The toy gun according to claim 3, wherein the second valve portion includes a check valve.

5. The toy gun according to claim 1 or 2, wherein the air chamber body, the gas introduction portion, the gas cartridge attachment portions, the first valve portions, and the valve are configured as a unit and can be attached and detached as a whole.

6. The toy gun according to claim 3, further comprising:

an attachment device for conveying compressed gas from the pair of gas cartridges disposed therein, including:

a hollow container extending along a longitudinal axis and having an internal space sized to receive the pair of gas cartridges therein, the hollow container having a gas delivery end portion and a cartridge holding end portion disposed longitudinally opposite the gas delivery end portion, the gas delivery end portion including a gas cartridge attachment portion defining a top of the hollow container and a unit attaching portion integrally connected to gas cartridge attachment portion and projecting from the top of the hollow container and extending centrally along and about the longitudinal axis, the gas cartridge attachment portion and the unit attaching portion formed with a gas passageway having an attaching portion passageway segment extending along and about the longitudinal axis, through the unit attaching portion and partially into the gas cartridge attachment portion, a pair of gas cartridge attachment passageway segments disposed apart from one another and extending parallel to the longitudinal axis and a connector passageway segment extending perpendicularly to the longitudinal axis and interconnecting the attaching portion passageway segment and the pair of gas cartridge attachment passageway segments;

a pair of gas cartridge valves with a respective one of the pair of gas cartridge valves disposed in a respective one of the pair of gas cartridge attachment passageway segments, respective ones of the pair of gas cartridge valves operative to contact and fluidically communicate with respective ones of the pair of gas cartridges; and a unit attaching valve disposed in at least the attaching portion passageway segment and operative, when the pair of gas cartridge valves contact and fluidically communicate with the respective ones of the pair of gas cartridges, to either retain the compressed gas within the hollow container or allow the compressed gas to discharge therefrom.

7. The toy gun according to claim 1, wherein the attachment device includes a pair of cartridge holders operably connected to the cartridge holding end portion, each one of the pair of cartridge holders movable to and between a cartridge receiving position and a cartridge holding portion such that, in the cartridge receiving portion, respective ones of the gas cartridges are received in the internal space and, in the cartridge holding portion, respective ones of the gas cartridges are retained within the internal space by respective ones of the pair of cartridge holders and are urged into contact with the respective ones of the pair of gas cartridge valves to fluidically communicate with the gas passageway.

* * * * *